US005909090A

United States Patent [19]

Nakamura et al.

[11] Patent Number: 5,909,090

[45] Date of Patent: Jun. 1, 1999

[54] LIGHT-EMISSION CONTROLLING APPARATUS

[75] Inventors: Kenji Nakamura, Tokyo; Yoshio Katayama, Hyogo; Masahiro Ieda, Tokyo, all of Japan

[73] Assignee: Mitsubishi Denki Kabushiki Kaisha, Tokyo, Japan

[21] Appl. No.: 08/923,627

[22] Filed: Sep. 4, 1997

[30] Foreign Application Priority Data

Apr. 3, 1997 [JP] Japan ..... 9-085115

[51] Int. Cl.[6] ..... G05F 1/00

[52] U.S. Cl. ..... 315/307; 315/224; 315/308; 315/DIG. 7

[58] Field of Search ..... 315/307, 219, 315/224, 291, DIG. 7, 308

[56] References Cited

U.S. PATENT DOCUMENTS

| | | | |
|---|---|---|---|
| 5,111,118 | 5/1992 | Fellows et al. | 315/307 |
| 5,589,742 | 12/1996 | Ueda | 315/307 |
| 5,604,406 | 2/1997 | Gaus | 315/200 A |
| 5,604,411 | 2/1997 | Venkitasubrahmanian et al. | 315/224 |
| 5,646,484 | 7/1997 | Sharma et al. | 315/91 |
| 5,663,613 | 9/1997 | Yamashita et al. | 315/308 |
| 5,696,431 | 12/1997 | Giannopoulos et al. | 315/224 |
| 5,770,928 | 6/1998 | Chansky et al. | 315/362 |

FOREIGN PATENT DOCUMENTS

| | | |
|---|---|---|
| 6-243979 | 9/1994 | Japan . |
| 6243979 | 9/1994 | Japan . |

*Primary Examiner*—Don Wong
*Assistant Examiner*—Haissa Philogene
*Attorney, Agent, or Firm*—Sughrue, Mion, Zinn, Macpeak & Seas, PLLC

[57] ABSTRACT

There is provided a light-emission controlling apparatus comprising a light-emission time integrating unit (107) for measuring the integral of the length of time that an electric discharge lamp (106) has emitted light, a comparing unit (1082) for comparing the integral of the length of time that the electric discharge lamp (106) has emitted light which is measured by the light-emission time integrating unit (107) to a reference value, a light-emission mode selecting unit (1083) for selecting either a first light-emission mode or a second light-emission mode according to a comparison result from the comparing unit (1082) so as to cause the electric discharge lamp (106) to emit light in one light-emission mode selected, and a display controlling unit (1084) for transmitting information about the comparison result from the comparing unit (1082) as the information about the light-emission state of said light-emitting means, by way of a local are network (109), to a display device (500 and 501) disposed outside the light-emission controlling apparatus, and for displaying the information on the display device.

17 Claims, 18 Drawing Sheets

FIG.5

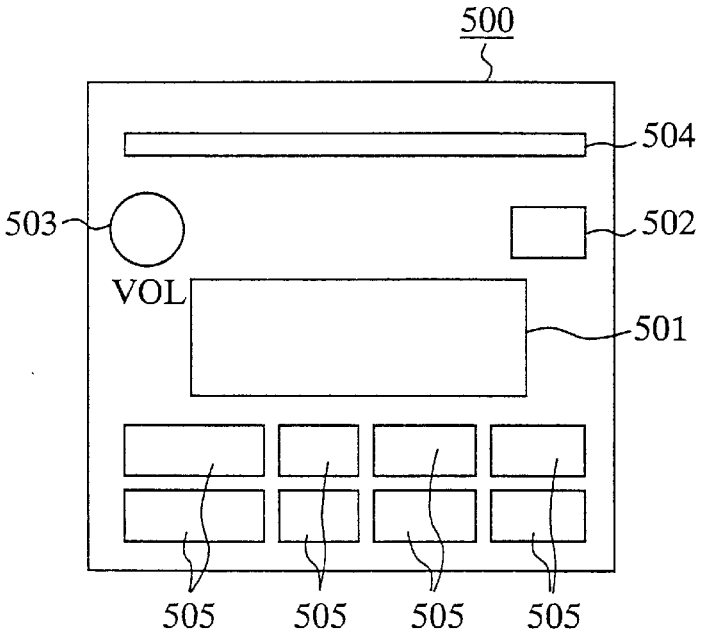

FIG.6a

501

THE REMAINING TIME THAT THE ELECTRIC DISCHARGE LAMP CAN EMIT LIGHT IS 600 HOURS.

THE REFERENCE LIGHT-EMISSION INTEGRATED TIME : 1000 HOURS
THE MEASURED INTEGRAL OF THE LENGTH OF TIME THAT THE ELECTRIC DISCHARGE LAMP HAS EMITTED LIGHT : 400 HOURS

FIG.6b

501

THE REMAINING TIME THAT THE ELECTRIC DISCHARGE LAMP CAN EMIT LIGHT IS 20 HOURS.
THE TIME TO REPLACE THE ELECTRIC DISCHARGE LAMP HAS COME. SO REPLACE IT.

THE REFERENCE LIGHT-EMISSION INTEGRATED TIME : 1000 HOURS
THE MEASURED INTEGRAL OF THE LENGTH OF TIME THAT THE ELECTRIC DISCHARGE LAMP HAS EMITTED LIGHT : 980 HOURS

THE REMAINING NUMBER OF TIMES THAT THE ELECTRIC DISCHARGE LAMP HAS EMIT LIGHT IS 600 TIMES.

THE REFERENCE LIGHT-EMISSION NUMBER OF TIMES : 1000 TIMES

THE MEASURED NUMBER OF TIMES THAT THE ELECTRIC DISCHARGE LAMP HAS EMITTED LIGHT : 400 TIMES

501

LIGHT-EMISSION CONTROLLING APPARATUS

BACKGROUND OF THE INVENTION

1. Field of the Invention

The present invention relates to a light-emission controlling apparatus disposed in an automobile or the like, for changing a light-emission mode of a light-emitting device such as an electric discharge lamp such as a high-voltage sodium lamp, or a metal halide lamp, or an incandescent lamp so that the light-emitting device switches between its light-emission modes.

2. Description of the Prior Art

Referring now to FIG. 22, there is illustrated a schematic diagram showing the structure of a prior art light-emission controlling apparatus disclosed in Japanese Patent Application Laying Open (KOKAI) No. 6-243979. In the figure, reference numeral 5 denotes an electric discharge lamp, 8 denotes a switch, 9 denotes a voltage detecting circuit having a terminal connected to a point of connection between capacitors 4*b* and 4*c* via the switch 8, for detecting a voltage across the electric discharge lamp 5 after an electric breakdown is produced in the electric discharge lamp 5, 11 denotes a current detecting circuit for detecting a current flowing through the electric discharge lamp 5, and 12 denotes an electric-breakdown detecting circuit for detecting a current which can rush into the electric discharge lamp 5 when an electric breakdown is produced in the electric discharge lamp 5 so as to generate a signal indicating whether or not an electric breakdown is produced.

Furthermore, reference numeral 13 denotes a control unit implemented via a microcomputer or the like, for switching on or off the switch 8 and for controlling the frequency of a signal delivered to an inverter circuit 2 according to signals from the voltage detecting circuit 9, the current detecting circuit 11, and the electric-breakdown detecting circuit 12, and 15 denotes an alarm lamp through which the control unit 13 can warn a user when it determines that the value of the lighting voltage across the electric discharge lamp 5, which is informed by the voltage detecting circuit 9, is not within the range of lighting voltage ratings.

In operation, when the light switch is turned on and an electric breakdown is produced in the electric discharge lamp 5, a current rushes into the electric discharge lamp 5. Then the electric-breakdown detecting circuit 12 detects the current rushing into the electric discharge lamp 5 and then furnishes a pulse indicating that an electric breakdown is produced to the control unit 13.

In response to the pulse from the electric-breakdown detecting circuit 12, the control unit 13 reads the value of the voltage across the electric discharge lamp 5 which is converted by the voltage detecting circuit 9 and compares the current value of the voltage across the electric discharge lamp with the minimum value of the lighting voltage ratings of the electric discharge lamp 5 which was preset to the control unit 13. If the control unit 13 determines that the current value of the voltage across the electric discharge lamp 5 is lower that the minimum value, it causes the alarm lamp 15 to light up.

On the contrary, if the control unit 13 determines that the current value of the voltage across the electric discharge lamp 5 is greater that or equal to the minimum value of the lighting voltage ratings of the electric discharge lamp 5, it further compares the current value of the voltage across the electric discharge lamp to the maximum value of the lighting voltage ratings of the electric discharge lamp 5 which was preset to the control unit 13. If the control unit 13 determines that the current value of the voltage across the electric discharge lamp is greater that the maximum value, it causes the alarm lamp 15 to flash on and off.

Since the prior art light-emission controlling apparatus is so constructed as mentioned above, there is a problem in that the provision of the alarm lamp has to be made in addition to the electric discharge lamp in order to warn the user that the value of the voltage across the electric discharge lamp 5 is not within the range of lighting voltage ratings, and hence it increases the hardware cost.

Another problem with the prior art light-emission controlling apparatus is that it is difficult for the user to realize the current light-emission state of the electric discharge lamp 5 because the user cannot get specific information about the light-emission state of the electric discharge lamp 5.

SUMMARY OF THE INVENTION

The present invention is made to overcome the problems. It is therefore an object of the present invention to provide a light-emission controlling apparatus which makes it possible for the user to easily realize the current light-emission state of a light-emitting device such as an electric discharge lamp, without having to provide an alarm lamp or the like in addition to the light-emitting device.

In accordance with one aspect of the present invention, there is provided a light-emission controlling apparatus comprising: a light-emitting device for emitting light; a detecting unit for detecting a light-emission state of the light-emitting device; a control unit for selecting one from at least first and second light-emission modes according to the light-emission state of the light-emitting device detected by the detecting unit, and for enabling the light-emitting device to emit light in the selected first or second light-emission mode; and a local area network through which information about the light-emission state of the light-emitting device detected by the detecting unit is transmitted.

Preferably, the control unit includes a comparing unit for comparing the light-emission state of the light-emitting device detected by the detecting unit to a reference light-emission state of the light-emitting device, and a light-emission mode selecting unit for selecting either the first light-emission mode or the second light-emission mode according to a comparison result from the comparing unit.

The control unit can transmit information about the comparison result from the comparing unit, as the information about the light-emission state of the light-emitting device, to a display device disposed outside the light-emission controlling apparatus by way of the local area network, and for displaying the information about the comparison result on the display device.

In accordance with a preferred embodiment of the present invention, the detecting unit can detect the light-emission state of the light-emitting device by acquiring information showing how long or how many times the light-emitting device has been used. Preferably, the detecting unit includes a unit for measuring the integral of the length of time that the light-emitting device has emitted light since the light-emitting device was attached to the light-emission controlling apparatus, and the comparing unit compares the measured integral of the length of time that the light-emitting device has emitted light to a reference value showing the reference light-emission state of the light-emitting device. Furthermore, the light-emission mode selecting unit selects the second light-emission mode when the comparison result indicates that the measured integral of the length of time that the light-emitting device has emitted light is greater than the reference value, and the light-emission mode selecting unit selects the first light-emission mode otherwise.

Alternatively, the detecting unit can include a unit for counting the number of times that the light-emitting device has emitted light since the light-emitting device was attached to the light-emission controlling apparatus, and the comparing unit compares the measured number of times that the light-emitting device has emitted light to a reference value showing the reference light-emission state of the light-emitting device. Furthermore, the light-emission mode selecting unit selects the second light-emission mode when the comparison result indicates that the measured number of times that the light-emitting device has emitted light is greater than the reference value, and the light-emission mode selecting unit selects the first light-emission mode otherwise.

Alternatively, the detecting unit can include a unit for measuring intensity of light emitted out of the light-emitting device, temperature of the light-emitting device or ambient temperature in the vicinity of the light-emitting device, power supplied to the light-emitting device, or a voltage applied to the light-emitting device, and the comparing unit compares the measurement result by the measuring unit to a corresponding reference value showing the reference light-emission state of the light-emitting device. Furthermore, the light-emission mode selecting unit selects the second light-emission mode when the comparison result indicates that the value of the measured light intensity is lower than its corresponding reference value, the value of the measured temperature is greater than its corresponding reference value, the value of the measured power is greater than its corresponding reference value, or the value of the measured voltage is greater than its corresponding reference value, and the light-emission mode selecting unit selects the first light-emission mode otherwise.

Preferably, when the light-emission mode selecting unit selects the first light-emission mode, the control unit enables the light-emitting device to simply light up, and when the light-emission mode selecting unit selects the second light-emission mode, the control unit enables the light-emitting device to flash on and off during a predetermined period of time. Alternatively, when the light-emission mode selecting unit selects the first light-emission mode, the control unit enables the light-emitting device to simply light up, and when the light-emission mode selecting unit selects the second light-emission mode, the control unit enables the light-emitting device to flash on and off a predetermined number of times.

In accordance with another preferred embodiment of the present invention, the detecting unit can detect the light-emission state of the light-emitting device by acquiring plural pieces of information each showing how long or how many times the light-emitting device has been used. Furthermore, the control unit can select one from among a plurality of light-emission modes according to the plural pieces of information acquired by the detecting unit, and for enabling the light-emitting device to emit light in one the light-emission mode selected.

In accordance with anther aspect of the present invention, there is provided a light-emission controlling apparatus comprising: a light-emitting device for emitting light; a unit for determining whether or not a time to replace the light-emitting device has come so as to select a first light-emission mode when determining that a time to replace the light-emitting device has not come and select a second light-emission mode when determining that a time to replace the light-emitting device has come, and for enabling the light-emitting device to emit light in the selected first or second light-emission mode; and a local area network through which information about the light-emission state of the light-emitting device detected by the detecting unit is transmitted.

In accordance with a preferred embodiment of the present invention, the determining unit includes a unit for measuring the integral of the length of time that the light-emitting device has emitted light since the light-emitting device was attached to the light-emission controlling apparatus, a comparing unit for comparing the measured integral of the length of time that the light-emitting device has emitted light to a reference value, a light-emission mode selecting unit for selecting either the first light-emission mode or the second light-emission mode according to a comparison result from the comparing unit, and a display controlling unit for transmitting information about the comparison result from the comparing unit, as the information about the light-emission state of the light-emitting device, to a display device disposed outside the light-emission controlling apparatus by way of the local area network, and for displaying the information about the comparison result on the display device.

In accordance with another preferred embodiment of the present invention, the determining unit can include a unit for counting the number of times that the light-emitting device has emitted light since the light-emitting device was attached to the light-emission controlling apparatus, a comparing unit for comparing the measured number of times that the light-emitting device has emitted light to a reference value, a light-emission mode selecting unit for selecting either the first light-emission mode or the second light-emission mode according to a comparison result from the comparing unit, and a display controlling unit for transmitting information about the comparison result from the comparing unit, as the information about the light-emission state of light-emitting device, to a display device disposed outside the light-emission controlling apparatus by way of the local area network, and for displaying the information about the comparison result on the display device.

In accordance with another preferred embodiment of the present invention, the determining unit includes a unit for measuring intensity of light emitted out of the light-emitting device, temperature of the light-emitting device or ambient temperature in the vicinity of the light-emitting device, power supplied to the light-emitting device, or a voltage applied to the light-emitting device, a comparing unit for comparing the light intensity, temperature, power, or voltage measured by the measuring unit to a corresponding reference value, a light-emission mode selecting unit for selecting either the first light-emission mode or the second light-emission mode according to a comparison result from the comparing unit, and a display controlling unit for transmitting the information about the comparison result from the comparing unit, as the information about the light-emission state of the light-emitting device, to a display device disposed outside the light-emission controlling apparatus by way of the local area network, and for displaying the information about the comparison result on the display device.

When the light-emission mode selecting unit selects the first light-emission mode, the control unit enables the light-emitting device to simply light up, and when the light-emission mode selecting unit selects the second light-emission mode, the control unit enables the light-emitting device to flash on and off during a predetermined period of time. Alternatively, when the light-emission mode selecting unit selects the first light-emission mode, the control unit enables the light-emitting device to simply light up, and when the light-emission mode selecting unit selects the second light-emission mode, the control unit enables the light-emitting device to flash on and off a predetermined number of times.

Further objects and advantages of the present invention will be apparent from the following description of the preferred embodiments of the invention as illustrated in the accompanying drawings.

BRIEF DESCRIPTION OF THE DRAWINGS

FIG. 5 is a front view of a sound device;

FIG. 6*a* is a view showing an example of a message displayed on a display unit of the sound device shown in FIG. 5;

FIG. 6*b* is a view showing another example of a message displayed on a display unit of the sound device shown in FIG. 5;

DETAILED DESCRIPTION OF THE PREFERRED EMBODIMENTS

First Embodiment

Figure 1:
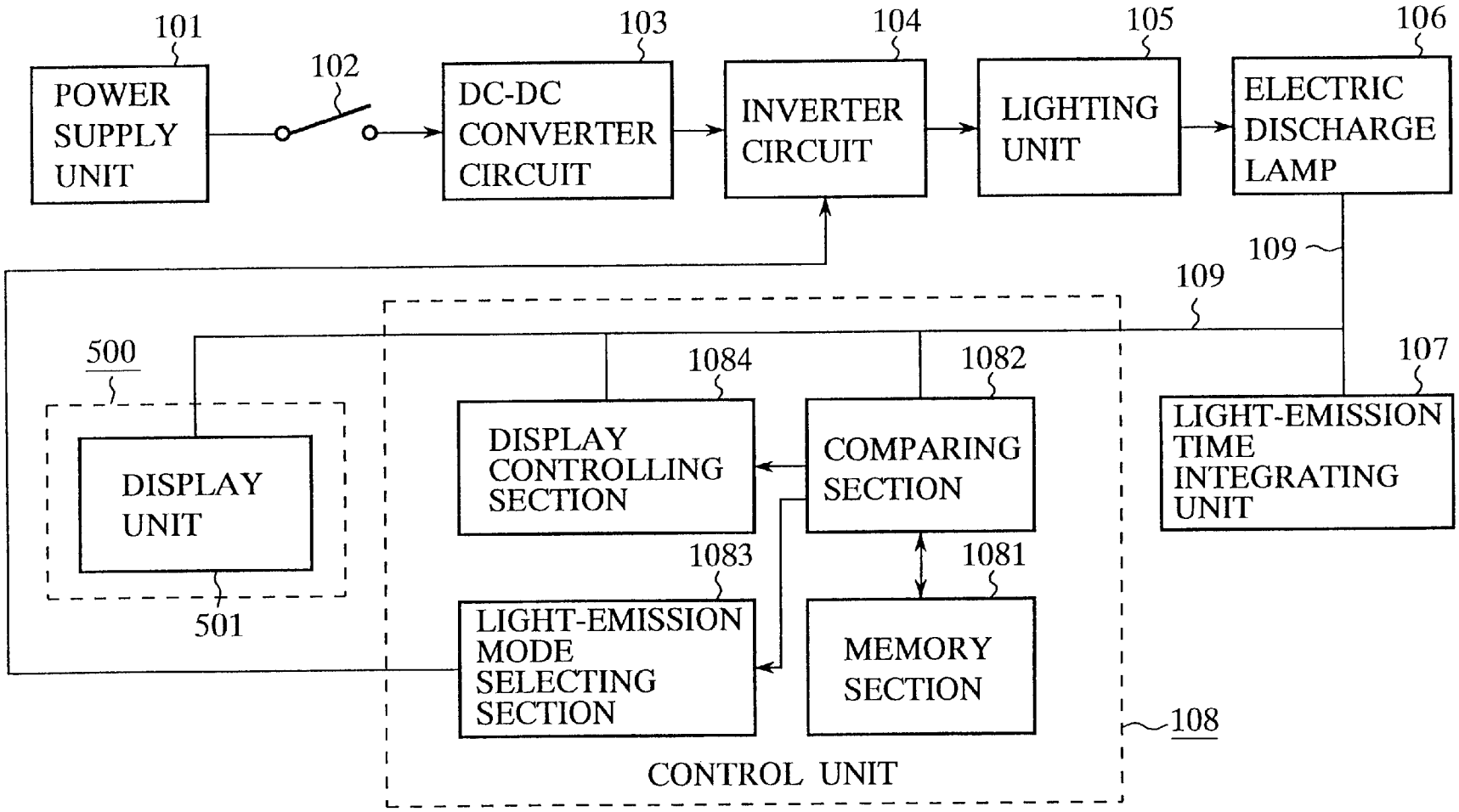
FIG. 1 is a block diagram showing the structure of a light-emission controlling apparatus according to a first embodiment of the present invention.

Referring now to FIG. 1, there is illustrated a block diagram showing the structure of a light-emission controlling apparatus according to a first embodiment of the present invention. In the figure, 101 denotes a power supply disposed within an automobile or motor vehicle, 102 denotes a switch for turning on or off the power supply 101, 103 denotes a converter circuit for DC—DC converting a voltage which is applied thereto via the switch 102 by the power supply 101, and 104 denotes an inverter circuit for amplifying a signal into which the voltage is converted by the converter circuit 103.

The inverter circuit 104 is provided with a switching element (not shown) which is turned on and off alternately, a step-up transformer (not shown) for raising the voltage of the power supply 101 converted to AC by the switching element to generate a desired voltage, and a coupling capacitor (not shown).

Reference numeral 105 denotes a lighting unit for lighting an electric discharge lamp 106, which is disposed as a light-emitting device, with the voltage furnished by the inverter circuit 104, and 107 denotes a light-emission time integrating unit which is disposed as a means for detecting the light-emission state of the electric discharge lamp 106. The light-emission time integrating unit 107 is adapted to measure the integral of the length of time that the electric discharge lamp 106 mounted in the light-emission control apparatus has emitted light since the electric discharge lamp 106 was attached to the light-emission controlling apparatus of this embodiment.

Furthermore, reference numeral 108 denotes a control unit provided with a memory section 1081 for prestoring a reference value (e.g., one thousand hours) of the integral of the length of time that the electric discharge lamp 106 has emitted light since it was attached to the light-emission controlling apparatus, a comparing section 1082 for comparing the integral of the length of time showing the light-emission state of the electric discharge lamp 106, which is measured by the light-emission time integrating unit 107, to the reference value stored in the memory section 1081, a light-emission mode selecting section 1083 for selecting either a first light-emission mode wherein the electric discharge lamp 106 emits light normally (i.e., simply lights up) or a second light-emission mode wherein, for example, the electric discharge lamp 106 flashes on and off during a predetermined period of time, according to the comparison result obtained by the comparing section 1082, to furnish a selecting signal to the inverter circuit 104, so that the inverter circuit 104 enables the lighting unit 105 to light the electric discharge lamp 106, and a display controlling section 1084 for displaying information about the comparison result from the comparing section 1082 on the screen of a display unit 501 of a sound device 500 disposed outside the light-emission controlling apparatus according to the present invention. The light-emission mode selecting section 1083 selects the second light-emission mode when the integral of the length of light-emission time measured by the light-emission time integrating unit 107 exceeds the reference value stored in the memory section 1081. In this specification, the reference value is referred to as the reference light-emission integrated time. Similarly, the integral of the length of time that the electric discharge lamp has emitted light since it was attached to the light-emission controlling apparatus is referred to as the light-emission integrated time.

The inverter circuit 104 thus enables the lighting unit 105 to cause the electric discharge lamp 106 to emit light in either the first or second light-emission mode according to the selecting signal furnished by the light-emission mode selecting section 1083.

Furthermore, reference numeral 109 denotes a local area network (LAN) which is disposed as a communications means through which the control unit 108 communicates with the sound device 500, light-emission time integrating unit 107, and so on, in order to, for example, transmit the above-mentioned information from the comparing section 1082 to the sound device 500 which is disposed separately from the light-emission controlling apparatus As shown in FIG. 1, the display controlling section 1084, the light-emission time integrating unit 107, and the electric discharge lamp 106 are connected to the LAN 109 as well.

As previously mentioned, the sound device 500 connected to the LAN 109 disposed within a vehicle such as an automobile together with the light-emission controlling apparatus includes the display unit 501 for displaying information about the comparison result from the comparing section 1082 according to a display control signal furnished by the display controlling section 1084 of the light-emission controlling apparatus.

Figure 2:
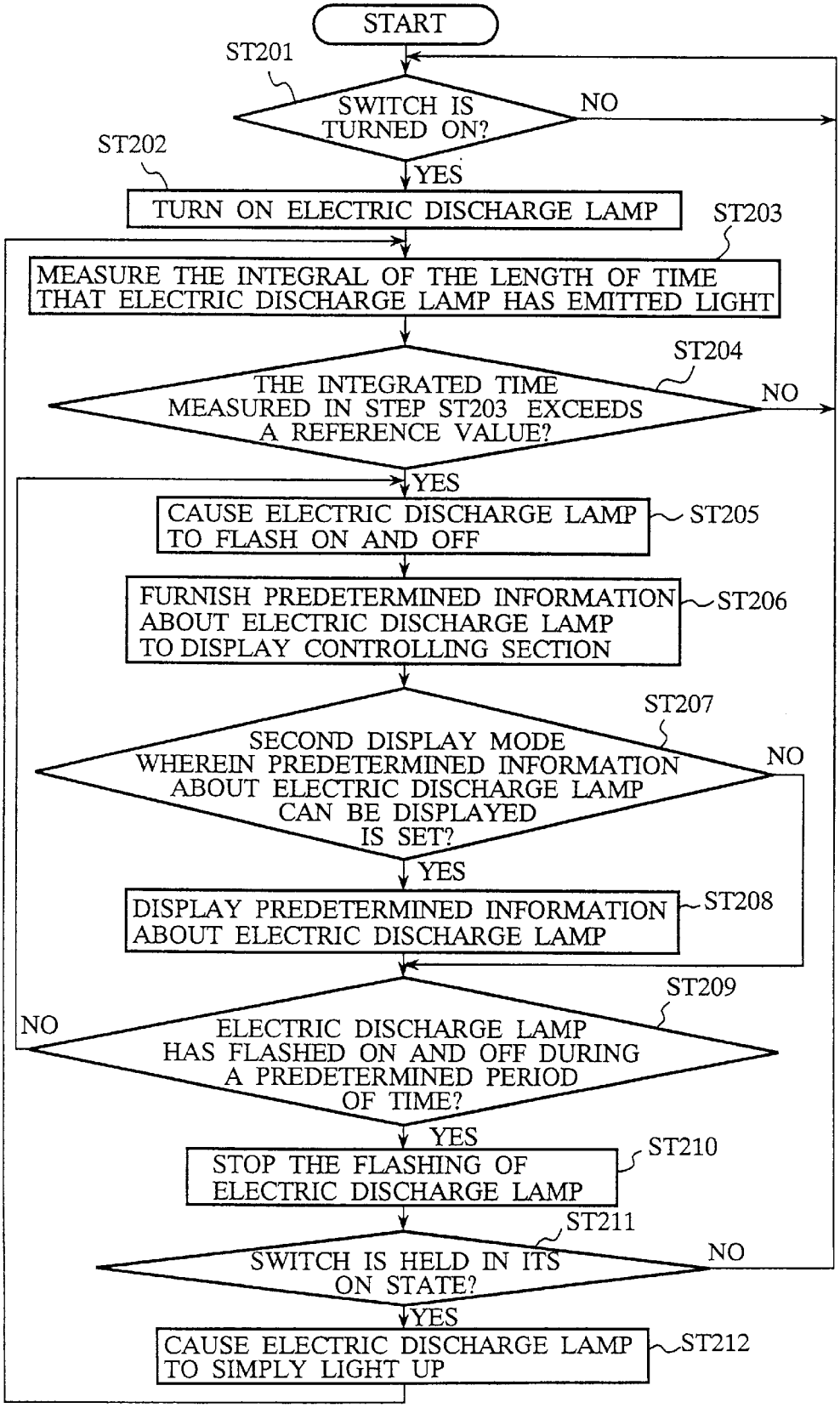
FIG. 2 is a flow diagram showing the operation of the light-emission controlling apparatus shown in FIG. 1.

Referring next to FIG. 2, there is illustrated a flow diagram showing the operation of the light-emission controlling apparatus shown in FIG. 1. Next, a description will be made as to the operation of the light-emission controlling apparatus according to the first embodiment of the present invention with reference to FIG. 2. When the user, for example, switches on a switch (not shown), the light-emission controlling apparatus is initiated and the switch 102 is closed, so that the DC—DC converter circuit 103 is coupled to the power supply 101. The DC—DC converter 103 then in step ST201 determines whether or not the switch 102 is turned on. The DC—DC converter 103 can make the determination by detecting a current flowing from the power supply 101 into the DC—DC converter.

When the DC—DC converter 103 in step ST201 determines that the switch 102 is turned on, the DC—DC converter 103, in step ST202, enables the inverter circuit 104 to allow the lighting unit 105 to light the electric discharge lamp 106 in the first light-emission mode. On the other hand, when it is determined that the switch 102 is held in its off state in step ST201, the control unit 108 repeats step ST201.

After performing step ST202, the light-emission time integrating unit 107, in step ST203, measures the integral of the length of time that the electric discharge lamp 106 has emitted light since it was attached to the light-emission controlling apparatus. The comparing section 1082 then in step ST204 compares the measured integral of the length of time that the electric discharge lamp has emitted light to the reference light-emission integrated time stored in the storing section 1081.

Figure 3:
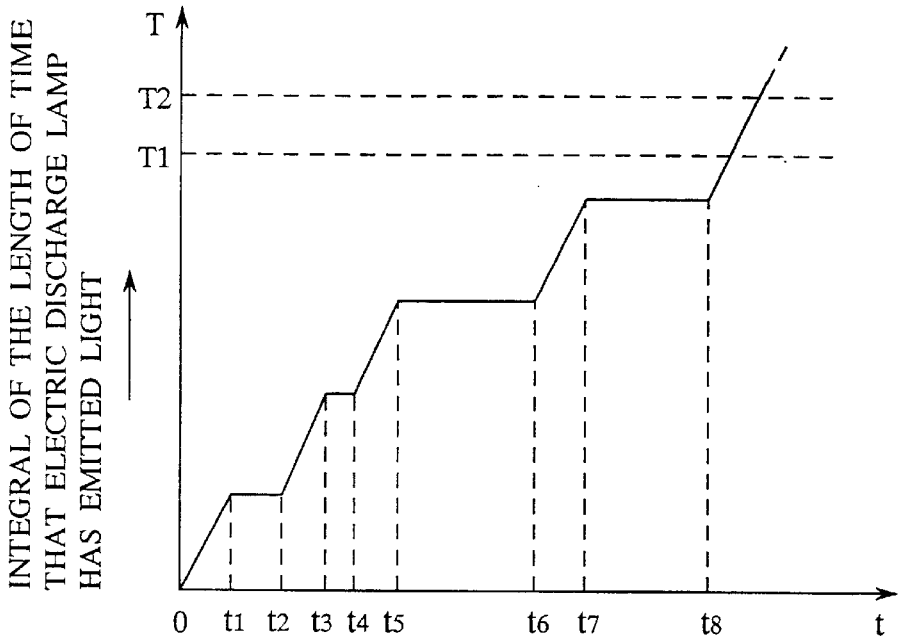
FIG. 3 is a diagram showing a relationship between the time that has elapsed since an electric discharge lamp was attached to the light-emission controlling apparatus and the integral of the length of time that the electric discharge lamp has emitted light since it was attached to the light-emission controlling apparatus.

Next, a description will be made as to the comparing process performed in step ST204 with reference to FIG. 3. FIG. 3 shows a relationship between the time that has elapsed since the electric discharge lamp 106 was attached to the light-emission controlling apparatus and the integral of the length of time that the electric discharge lamp 106 has emitted light since it was attached to the light-emission controlling apparatus. In FIG. 3, the horizontal axis shows the time that has elapsed since the electric discharge lamp 106 was attached to the light-emission controlling apparatus, and the vertical axis shows the integral of the length of time that the electric discharge lamp 106 has emitted light since it was attached to the light-emission controlling apparatus. Furthermore, T1 shows the reference light-emission integrated time, and T2 shows a limit of the integral of the length of time that the electric discharge lamp 106 can continue to emit light, and, in general, shows the time to replace the electric discharge lamp 106, that is, it means the lifetime of the electric discharge lamp 106.

In FIG. 3, a plurality of horizontal parts (t1→t2, t3→t4, t5→t6, t7→t8) each indicates that during each of the corresponding periods of time, the switch 102 is held in its off state and hence the light-emission integrated time is not varied, and a plurality of other parts (0→t1, t2→t3, t4→t5, t6→t7, t8→current time) each indicates that during each of the corresponding periods of time, the switch 102 is held in its on state and hence the light-emission integrated time is increased.

The comparing section 1082 compares the reference light-emission integrated time T1 (e.g., one thousand hours) to the current light-emission integrated time (e.g., four hundred hours at t4) measured by the light-emission time integrating unit 107 so as to determine whether or not the measured light-emission integrated time exceeds the reference light-emission integrated time T1. When it is determined, in step ST204, that the measured light-emission integrated time exceeds the reference light-emission integrated time T1, but is lower than the limit T2 of the light-emission integrated time, the light-emission mode selecting section 1083 furnishes a selecting signal for selecting the second light-emission mode to enable the inverter circuit 104 to cause the electric discharge lamp 106 to flash on and off during a predetermined period of time, i.e., a predetermined number of times. The inverter circuit 104 then in step ST205 causes the electric discharge lamp 106 to flash on and off during the predetermined period of time according to the selecting signal from the light-emission mode selecting section 1083 through the lighting unit. On the other hand, when it is determined, in step ST204, that the measured light-emission integrated time does not exceed the reference light-emission integrated time T1, the control unit 108 returns to step ST201 and repeats the above processing.

Figure 4A:
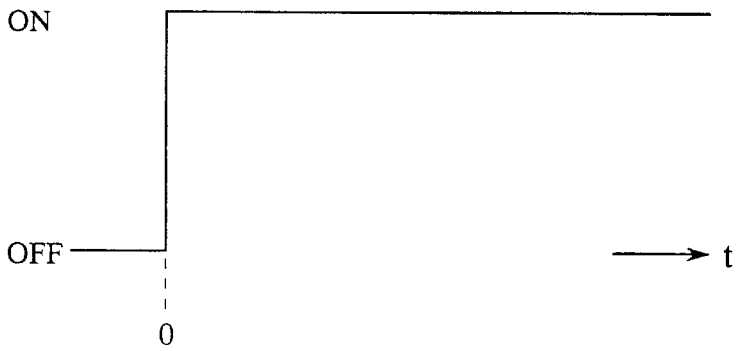
FIG. 4*a* is a diagram showing the waveform of a control signal applied to a lighting unit to cause the electric discharge lamp to simply light up when a first light-emission mode is selected.
Figure 4B:
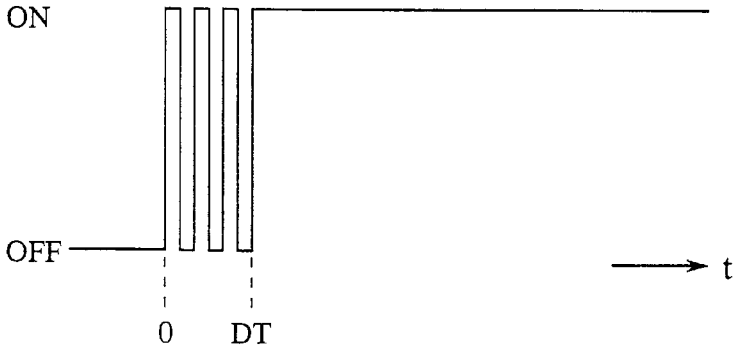
FIG. 4*b* is a diagram showing the waveform of a control signal applied to the lighting unit to cause the electric discharge lamp to flash on and off when a second light-emission mode is selected.

Next, a description will be made as to how the inverter circuit 104 causes the electric discharge lamp 106 to simply light up or flash on and off in performing step ST205 with reference to FIGS. 4*a* and 4*b*. FIG. 4*a* is a diagram showing the waveform of a control signal applied to the lighting unit for causing the electric discharge lamp 106 to simply light up when the first light-emission mode is selected, and FIG. 4*b* is a diagram showing the waveform of a control signal applied to the lighting unit for causing the electric discharge lamp 106 to flash on and off when the second light-emission mode is selected. As shown in FIG. 4*a,* in the first light-emission mode, the inverter circuit 104 generates a control signal to enable the electric discharge lamp 106 to perform only one switching operation from its off state to its on state and hence simply light up. As shown in FIG. 4*b,* in the second light-emission mode, the inverter circuit 104 generates a control signal to enable the electric discharge lamp 106 to perform the switching between its on and off states only a predetermined number of times (e.g., three times) and hence flash on and off the predetermined number of times until a predetermined time DT elapses since the light-emission mode selecting unit 1083 selected the second light-emission mode.

Next, a description will be made as to the sound device with reference to FIG. 5. FIG. 5 is a front view of the sound device 500. In the figure, reference numeral 502 denotes a display mode selecting switch for switching the display unit 501 between a first display mode in which information about the sound device 500 can be displayed on the display unit 501 and a second display mode in which information about the electric discharge lamp 106 can be displayed on the display unit 50, 503 denotes a power switch for switching on or off a power supply for supplying power to the sound device 500, which also serves as a volume control, 504 denotes an inlet and outlet through which a compact disc (CD) is inserted into or discharged out of the sound device, and 505 denotes a plurality of operating switches for controlling the operation of the sound device 500.

After the inverter circuit 104 causes the electric discharge lamp 106 to flash on and off in step ST205, the comparing section 1082, in step ST206, furnishes predetermined information about the comparison result obtained in step ST204 to the display controlling section 1084. After performing step ST206, the display controlling section 1084, in step ST207, determines if the display mode selecting switch 502 shown in FIG. 5 is set to the second display mode in which the display unit 501 can display predetermined information about the electric discharge lamp 106 on the screen thereof, by communicating with the sound device 500 through LAN 109.

If the display controlling section 1084, in step ST207, determines that the display mode selecting switch 502 is set to the second display mode in which predetermined information about the electric discharge lamp 106 can be displayed on the display unit 501, the display controlling section 1084, in step ST208, furnishes predetermined information about the electric discharge lamp 106 including information about the comparison result from the comparing section 1082, to the sound device 500 by way of LAN 109, and then displays the predetermined information on the display unit 501.

Next, a description will be made as to the predetermined information displayed on the display unit in step ST208 with reference to FIGS. 6*a* and 6*b*. FIG. 6*a* shows an example of the predetermined information displayed on the display unit 501. In this case, the display controlling section 1084 displays a message "The remaining time that the electric discharge lamp can emit light is 600 hours" according to the comparison result from the comparing section 1082 as well as pieces of information about the electric discharge lamp: "The reference light-emission integrated time is one thousand hours, and the measured integral of the length of time that the electric discharge lamp has emitted light is 400 hours".

FIG. 6*b* shows another example of the predetermined information displayed on the display unit 501. In this case, since the remaining time that the electric discharge lamp can emit light is 20 hours and hence it is smaller than or equal to a predetermined value, e.g., fifty hours, the display controlling section 1084 displays a message "The time to replace the electric discharge lamp has come. So replace it" together with a message as shown in FIG. 6*a* as well as pieces of information about the electric discharge lamp: "The reference light-emission integrated time is one thousand hours, and the measured integral of the length of time that the electric discharge lamp has emitted light is 980 hours".

After the display controlling section 1084 displays the predetermined information as shown in FIG. 6*a* or 6*b* on the display unit 501 in step ST208, the lighting unit 105 then in step ST209 determines whether or not the inverter circuit 104 has performed the switching between its on and off states during the predetermined period of time DT (e.g., thirty seconds) so as to cause the electric discharge lamp 106 to flash on and off during the predetermined period of time DT. As previously mentioned, during the predetermined time period DT the electric discharge lamp 106 flashes on and off only the predetermined number of times, e.g., only three times. When it is determined, in step ST209, that the predetermined time DT has elapsed since the electric discharge lamp 106 started to flash on and off, the inverter circuit 104 causes the electric discharge lamp 106 to stop flashing in step ST210. The DC—DC converter 103 then in step ST211 determines whether the switch 102 is held in its on state or the switch 102 has been switched to its off state. On the other hand, when it is determined, in step ST209, that the predetermined time DT has not elapsed since the electric discharge lamp 106 started to flash on and off, the control unit 108 returns to step ST205.

When it is determined, in step ST211, that the switch 102 is held in its on state, the inverter circuit 104 causes the electric discharge lap 106 to simply light up in step ST212. After performing step ST212, the control unit 108 returns to step ST203 and repeats the above processing. On the other hand, when it is determined, in step ST211, that the switch 102 has been already switched to its off state, the control unit 108 returns to step ST201 and repeats the above processing.

If the display controlling section 1084, in step ST207, determines that the display mode selecting switch 502 is set to the first display mode in which predetermined information about the sound device 500 can be displayed on the display unit 501, the control unit 108 advances to step ST209 in which the lighting unit determines if the electric discharge lamp 106 has flashed on and off during the predetermined time period DT. After that, when it is determined in step ST209 that the electric discharge lamp has flashed on and off during the predetermined time period, the control unit 108 advances to step ST210, as previously explained. On the other hand, unless the predetermined time DT has elapsed since the electric discharge lamp 106 started to flash on and off, the control unit 108 returns to step ST205.

Accordingly, the light-emission control apparatus according to the first embodiment of the present invention makes it possible to, when the measured light-emission integrated time of the electric discharge lamp 106 exceeds the reference light-emission integrated time T1, cause the electric discharge lamp 106 to flash on and off during the predetermined period of time and further provide the user with a message informing the user that the time to replace the electric discharge lamp 106 has come, before the measured light-emission integrated time reaches the limit T2 of the light-emission integrated time, in which case the light-emission state of the electric discharge lamp 106 can be easily made unstable. Therefore, the user can easily realize that the time to replace the electric discharge lamp 106 has come. Furthermore, since the user can easily recognize the current light-emission state of the electric discharge lamp 106 through the display unit, the user can realize, without delay, that the time to replace the electric discharge lamp 106 has come or there is something wrong with the electric discharge lamp 106. Thus the light-emission controlling apparatus can afford more convenience to the user.

Second Embodiment

Figure 7:
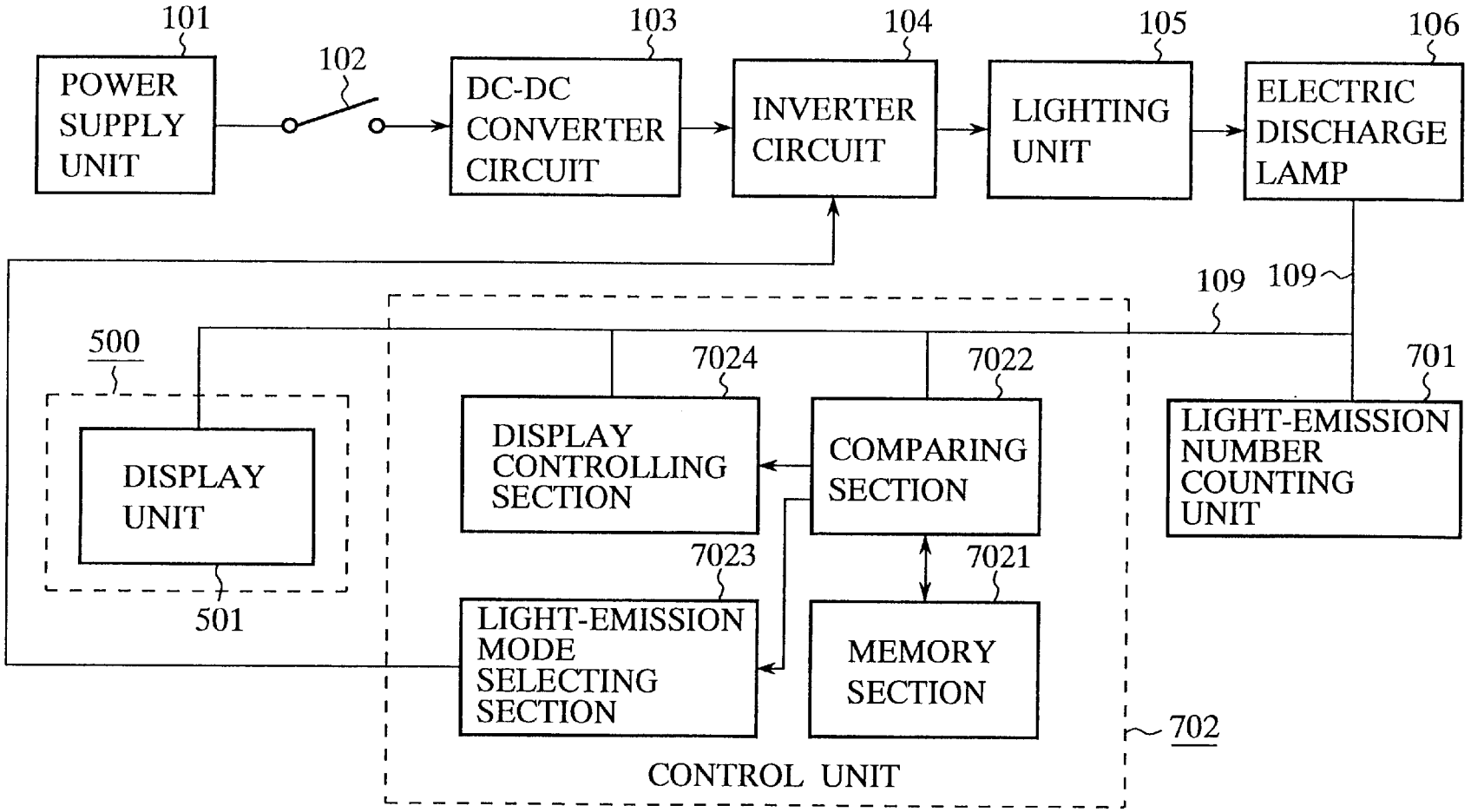
FIG. 7 is a block diagram showing the structure of a light-emission controlling apparatus according to a second embodiment of the present invention.

Referring now to FIG. 7, there is illustrated a block diagram showing the structure of a light-emission controlling apparatus according to a second embodiment of the present invention. In the figure, the same components as the light-emission controlling apparatus of the above-mentioned first embodiment or like components are designated by the same reference numerals as those in FIG. 1, and therefore the description about the components will be omitted hereinafter.

In FIG. 7, reference numeral 701 denotes a light-emission number counting unit for counting the number of times that the electric discharge lamp 106 has emitted light since the electric discharge lamp was attached to the light-emission controlling apparatus, which is disposed as a means for detecting the light-emission state of the electric discharge lamp 106. The light-emission number counting unit 701 is adapted to measure the number of times that the electric discharge lamp 106 mounted in the light-emission control apparatus has emitted light since it was attached to the light-emission controlling apparatus, for example, the number of times that the electric discharge lamp 106 has been turned on since it was attached to the light-emission controlling apparatus.

Furthermore, reference numeral 702 denotes a control unit provided with a memory section 7021 for prestoring a reference value (e.g., one thousand times) of the number of times that the electric discharge lamp 106 has emitted light since it was attached to the light-emission control apparatus, a comparing section 7022 for comparing the number of times that the electric discharge lamp 106 has emitted light since the electric discharge lamp was attached to the light-emission controlling apparatus, which shows the current light-emission state of the electric discharge lamp 106, and which is measured by the light-emission number counting unit 701, to the reference value stored in the memory section 7021, a light-emission mode selecting section 7023 for selecting either a first light-emission mode wherein the electric discharge lamp 106 emits light normally (i.e., simply lights up) or a second light-emission mode wherein, for example, the electric discharge lamp 106 flashes on and off during a predetermined period of time, according to the comparison result obtained by the comparing section 7022, to furnish a selecting signal to the inverter circuit 104, so that the inverter circuit 104 enables the lighting unit 105 to light the electric discharge lamp 106, and a display controlling section 7024 for displaying information about the comparison result from the comparing section 7022 on the screen of a display unit 501 of a sound device 500 disposed outside the light-emission controlling apparatus according to the present invention. The light-emission mode selecting section 7023 selects the second light-emission mode when the number of times that the electric discharge lamp 106 has emitted light since it was attached to the light-emission controlling apparatus, which is measured by the light-emission number counting unit 701, exceeds the reference value stored in the memory section 7021. In this specification, the reference value is referred to as the reference light-emission number of times. Similarly, the number of times that the electric discharge lamp 106 has emitted light since it was attached to the light-emission controlling apparatus is referred to as the light-emission number of times.

The inverter circuit 104 thus enables the lighting unit 105 to cause the electric discharge lamp 106 to emit light in either the first or second light-emission mode according to the selecting signal furnished by the light-emission mode selecting section 7023.

Figure 8:
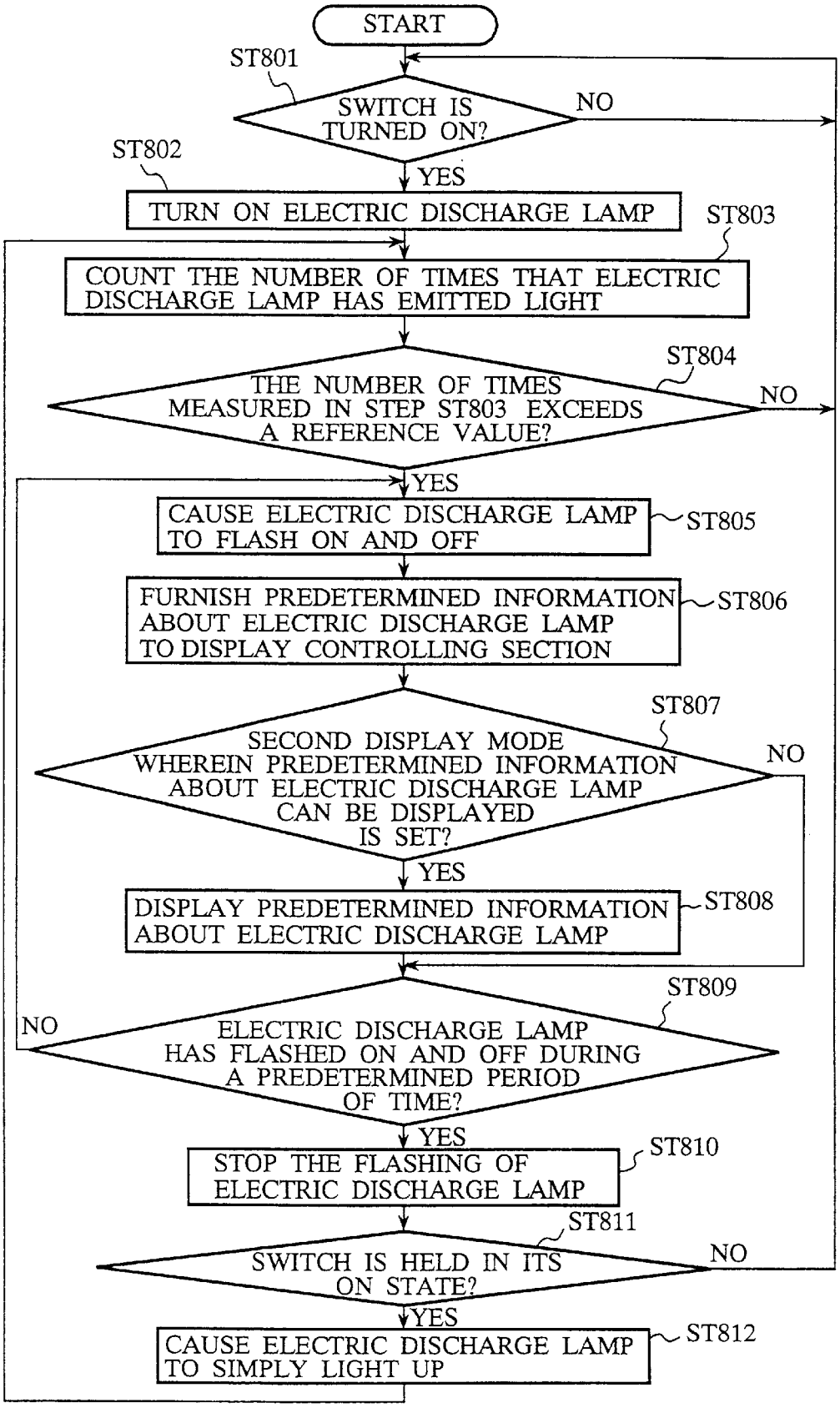
FIG. 8 is a flow diagram showing the operation of the light-emission controlling apparatus shown in FIG. 7.

Referring next to FIG. 8, there is illustrated a flow diagram showing the operation of the light-emission controlling apparatus shown in FIG. 7. Next, a description will be made as to the operation of the light-emission controlling apparatus according to the second embodiment of the present invention with reference to FIG. 8. When the user, for example, switches on a switch (not shown), the light-emission controlling apparatus is initiated and the switch 102 is closed, so that the DC—DC converter circuit 103 is coupled to the power supply 101. Then the control unit 702 advances to steps; ST801 and ST802. The processes performed in steps ST801 to ST802 are the same as those performed in steps ST201 to ST202 of the first embodiment mentioned above, and therefore the description about the processes will be omitted hereinafter.

After the inverter circuit 104 enables the electric discharge lamp 106 to emit light in performing step ST802, the light-emission number counting unit 701, in step ST803, counts the number of times that the electric discharge lamp 106 has emitted light since it was attached to the light-emission controlling apparatus by means of LAN 109. The comparing section 8022 then in step ST804 compares the measured number of times that the electric discharge lamp 106 has emitted light to the reference light-emission number of times stored in the storing section 7021 by means of LAN 109.

Figures 9, 10:
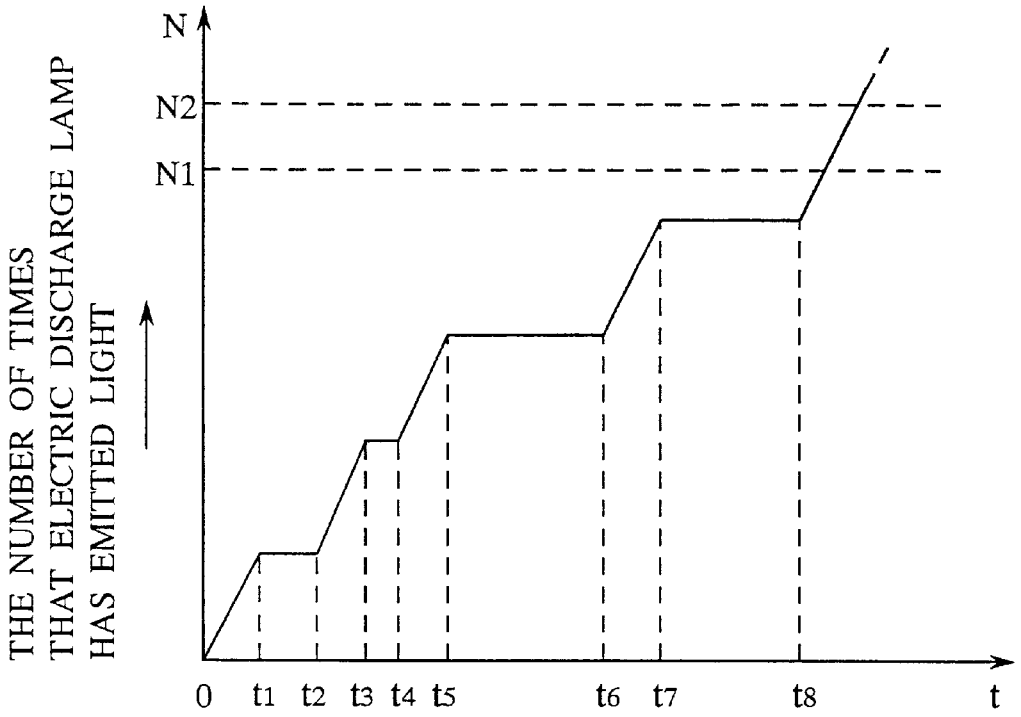
FIG. 9 is a graph showing a relationship between the time that has elapsed since an electric discharge lamp was attached to the light-emission controlling apparatus shown in FIG. 5 and the number of times that the electric discharge lamp has emitted light since it was attached to the light-emission controlling apparatus shown in FIG. 7.
FIG. 10 is a view showing an example of a message which is displayed on a display unit of the sound device by the light-emission controlling apparatus shown in FIG. 7.

Next, a description will be made as to the comparing process performed in step ST804 with reference to FIG. 9. FIG. 9 shows a relationship between the time that has elapsed since the electric discharge lamp 106 was attached to the light-emission controlling apparatus and the number of times that the electric discharge lamp 106 has emitted light since it was attached to the light-emission controlling apparatus. In FIG. 9, the horizontal axis shows the time that has elapsed since the electric discharge lamp 106 was attached to the light-emission control apparatus, and the vertical axis shows the number of times that the electric discharge lamp 106 has emitted light since it was attached to the light-emission control apparatus. Furthermore, N1 shows the reference light-emission number of times, and N2 shows a limit of the number of times that the electric discharge lamp 106 can emit light. In general, the limit N2 shows the time to replace the electric discharge lamp 106, that is, it means the lifetime of the electric discharge lamp 106.

In FIG. 9, horizontal parts (t1→t2, t3→t4, t5→t6, t7→t8) each indicates that during each of the corresponding periods of time, the switch 102 is held in its off state and hence the number of times that the electric discharge lamp 106 has emitted light is not varied, and other parts (0→t1, t2→t3, t4→t5, t6→t7, t8→current time) each indicates that during each of the corresponding periods of time, the switch 102 is turned on a number of times and hence the number of times that the electric discharge lamp 106 has emitted light is increased.

The comparing section 7022 compares the reference light-emission number of times N1 (e.g., one thousand times) to the current light-emission number of times (e.g., four hundred times at t4) measured by the light-emission number counting unit 701 so as to determine whether or not the measured light-emission number of times exceeds the reference light-emission number of times N1. When it is determined, in step ST804, that the measured light-emission number of times exceeds the reference light-emission number of times N1, but is lower than the limit N2 of the light-emission number of times, the light-light-emission mode selecting section 7023 furnishes a selecting signal for selecting the second light-emission mode to enable the inverter circuit 104 to cause the electric discharge lamp 106 to flash on and off during a predetermined period of time, i.e., only a predetermined number of times. The inverter circuit 104 then in step ST805 causes the electric discharge lamp 106 to flash on and off during the predetermined period of time according to the selecting signal from the light-light-emission mode selecting section 7023 through the lighting unit. On the other hand, when it is determined, in step ST804, that the measured light-emission number of times does not exceed the reference light-emission number of times N1, the control unit 702 returns to step ST801 and repeats the above processing.

After the inverter circuit 104 causes the electric discharge lamp 106 to flash on and off in step ST805, the comparing section 7022, in step ST806, furnishes predetermined information about the comparison result obtained in step ST804 to the display controlling section 7024. After performing step ST806, the display controlling section 7024, in step ST807, determines if the display mode selecting switch 502 shown in FIG. 5 is set to the second display mode in which the display unit 501 can display predetermined information about the electric discharge lamp 106 on the screen thereof, by communicating with the sound device 500 through LAN 109.

If the display controlling section 7024, in step ST807, determines that the display mode selecting switch 502 is set to the second display mode in which predetermined information about the electric discharge lamp 106 can be displayed on the display unit 501, the display controlling section 7024, in step ST808, furnishes predetermined information about the electric discharge lamp 106 including information about to the comparison result from the comparing section 7022, such as a message as shown in FIG. 10, to the sound device 500 by way of LAN 109, and then displays the predetermined information on the display unit 501. On the other hand, when it is determined, in step ST807, that the display mode selecting switch 502 is set to the first display mode in which predetermined information about the sound device 500 can be displayed on the display unit 501, the control unit 702 simply advances to step ST809.

After the display controlling section 7024 displays the predetermined information in step ST808, the control unit 702 advances to step ST809 wherein the lighting unit 105 determines whether or not the inverter circuit 104 has caused the electric discharge lamp 106 to flash on and off during the predetermined period of time DT (e.g., thirty seconds). After performing step ST809, the control unit 702 advances to steps ST810 to ST812. The processes in the steps ST810 to ST812 are performed similarly to the processes in steps ST210 to ST212 of the first embodiment mentioned above, and therefore the description about the processes in the steps ST810 to ST812 will be omitted hereinafter.

Accordingly, the light-emission controlling apparatus according to the second embodiment of the present invention makes it possible to, when the measured light-emission number of times that the electric discharge lamp 106 has emitted light exceeds the reference light-emission number of times N1, cause the electric discharge lamp 106 to flash on and off during the predetermined time period and further provide the user with a message informing the user that the time to replace the electric discharge lamp 106 has come, before the measured light-emission number of times reaches the limit N2, in which case the light-emission state of the electric discharge lamp 106 can be easily made unstable. Therefore, the user can easily realize that the time to replace the electric discharge lamp 106 has come. Furthermore, since the user can easily recognize the current light-emission state of the electric discharge lamp 106 through the display unit, the user can realize, without delay, that the time to replace the electric discharge lamp 106 has come or there is something wrong with the electric discharge lamp 106. Thus the light-emission controlling apparatus can afford more convenience to the user.

Third Embodiment

Figure 11:
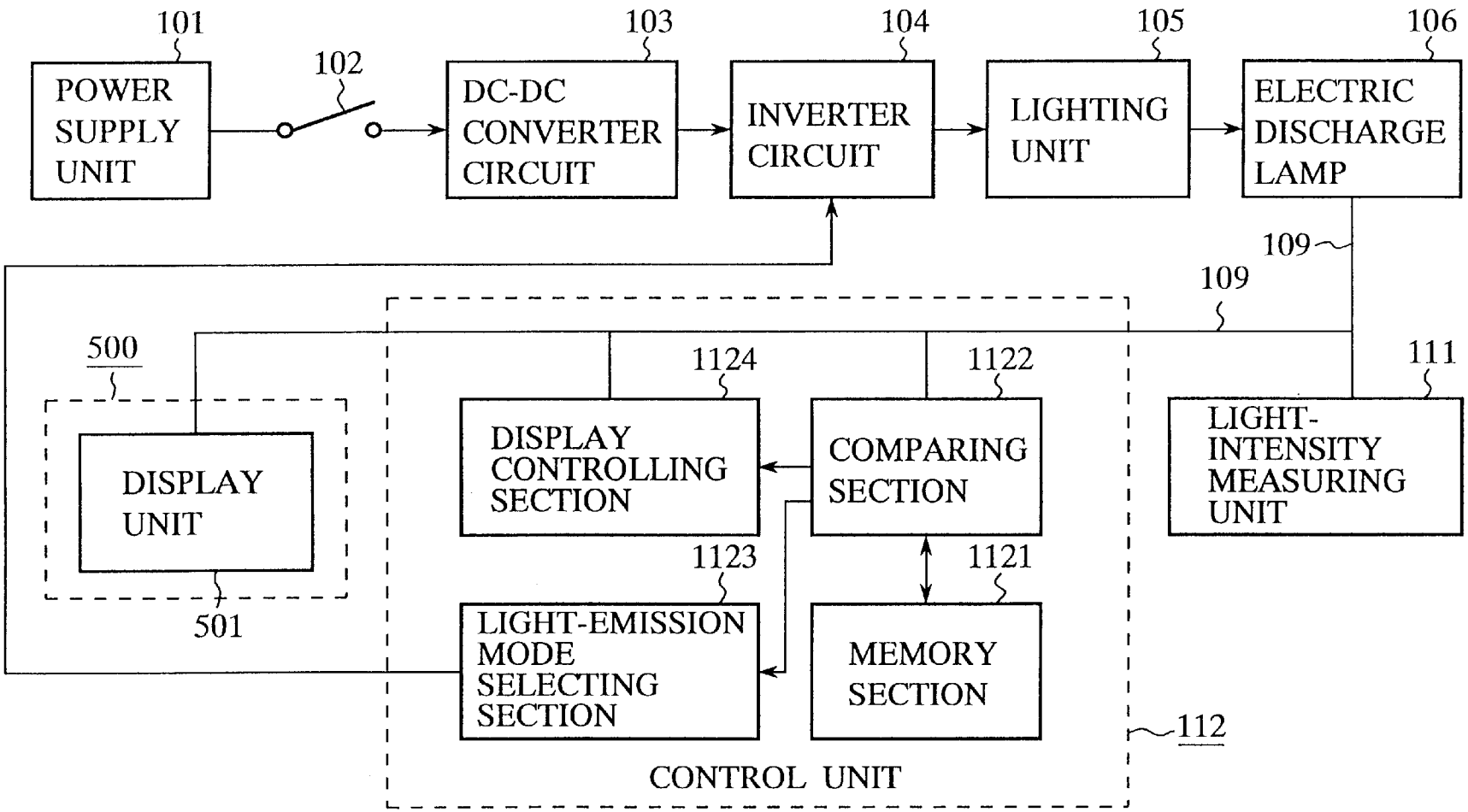
FIG. 11 is a block diagram showing the structure of a light-emission controlling apparatus according to a third embodiment of the present invention.

Referring now to FIG. 11, there is illustrated a block diagram showing the structure of a light-emission controlling apparatus according to a third embodiment of the present invention. In the figure, the same components as the light-emission controlling apparatus of the above-mentioned first embodiment or like components are designated by the same reference numerals as those in FIG. 1, and therefore the description about the components will be omitted hereinafter.

In FIG. 11, 111 denotes a light-intensity measuring unit which is disposed as a means for detecting the light-emission state of the electric discharge lamp 106. The light-intensity measuring unit 117 is adapted to directly or indirectly measure the intensity of light emitted out of the electric discharge lamp 106.

Furthermore, reference numeral 112 denotes a control unit provided with a memory section 1121 for prestoring a reference value (e.g., 60 lux) of the intensity of light emitted out of the electric discharge lamp 106, a comparing section 1122 for comparing the value of the light intensity showing the light-emission state of the electric discharge lamp 106, which is measured by the light-intensity measuring unit 111, to the reference value stored in the memory section 1121, a light-emission mode selecting section 1123 for selecting either a first light-emission mode wherein the electric discharge lamp 106 emits light normally (i.e., simply lights up) or a second light-emission mode wherein, for example, the electric discharge lamp 106 flashes on and off during a predetermined period of time, according to the comparison result obtained by the comparing section 1122, to furnish a selecting signal to the inverter circuit 104, so that the inverter circuit 104 enables the lighting unit 105 to light the electric discharge lamp 106, and a display controlling section 1124 for displaying information about the comparison result from the comparing section 1122 on the screen of a display unit 501 of a sound device 500 disposed outside the light-emission controlling apparatus according to the present invention. The light-emission mode selecting section 1083 selects the second light-emission mode when the value of the light intensity of the electric discharge lamp 106 measured by the light-intensity measuring unit 111 is lower than the reference value stored in the memory section 1121. In this specification, the reference value is referred to as the reference light intensity value.

The inverter circuit 104 thus enables the lighting unit 105 to cause the electric discharge lamp 106 to emit light in either the first or second light-emission mode according to the selecting signal furnished by the light-emission mode selecting section 1123.

Figure 12:
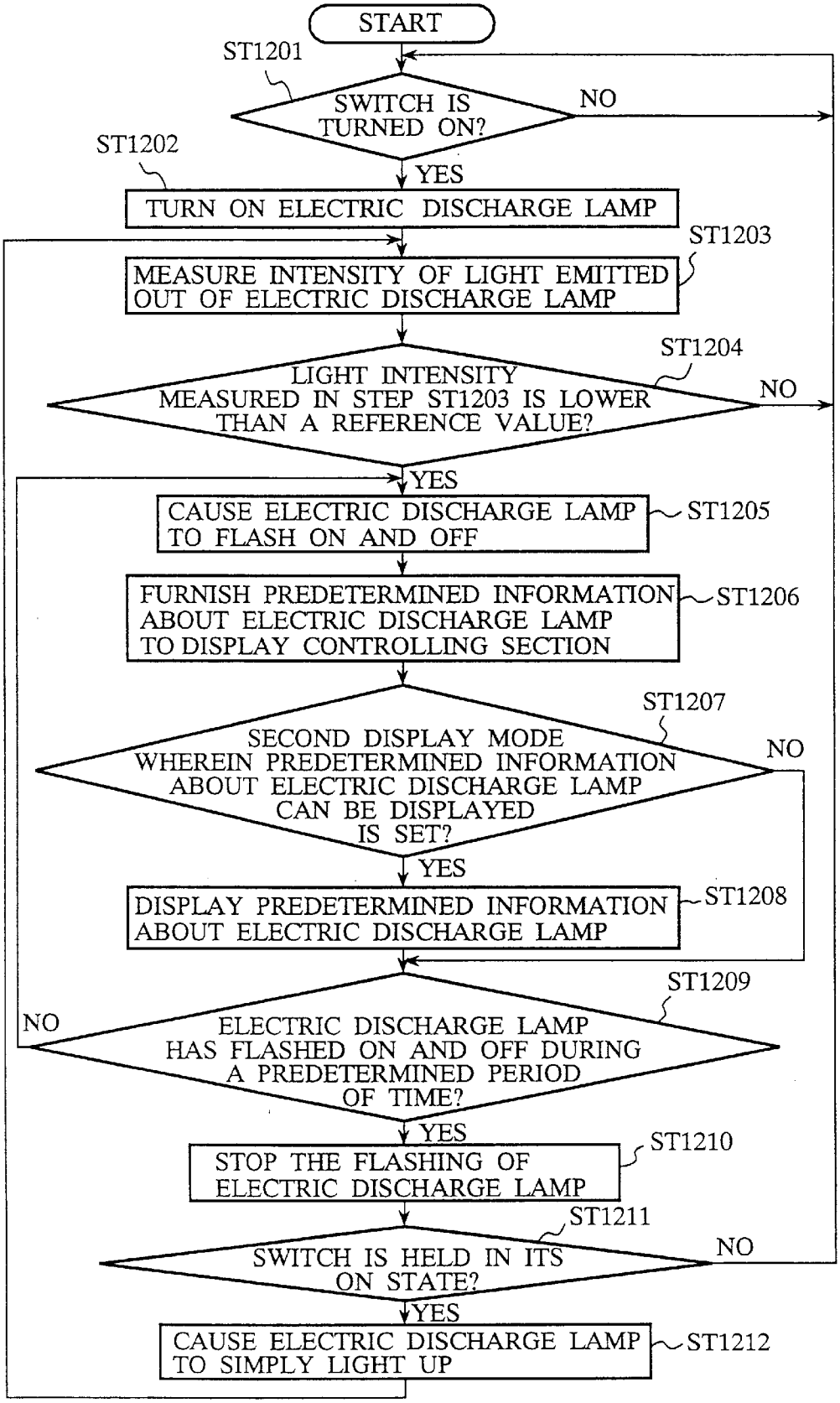
FIG. 12 is a flow diagram showing the operation of the light-emission controlling apparatus shown in FIG. 11.

Referring next to FIG. 12, there is illustrated a flow diagram showing the operation of the light-emission controlling apparatus shown in FIG. 11. Next, a description will be made as to the operation of the light-emission controlling apparatus according to the third embodiment of the present invention with reference to FIG. 12. When the user, for example, switches on a switch (not shown), the light-emission controlling apparatus is initiated and the switch 102 is closed, so that the DC—DC converter circuit 103 is coupled to the power supply 101. Then the control unit 112 advances to steps ST1201 and ST1202. The processes performed in steps ST1201 to ST1202 are the same as those performed in steps ST201 to ST202 of the first embodiment mentioned above, and therefore the description about the processes will be omitted hereinafter.

After the inverter circuit 104 enables the electric discharge lamp 106 to emit light in performing step ST1202, the light-intensity measuring unit 111, in step ST1203, directly or indirectly measures the intensity of light emitted out of the electric discharge lamp 106 by means of LAN 109. The comparing section 1122 then in step ST1204 acquires the value of the light intensity measured in step ST1203 by way of LAN 109 and them compares it to the reference light intensity value stored in the storing section 1121.

Figure 13:
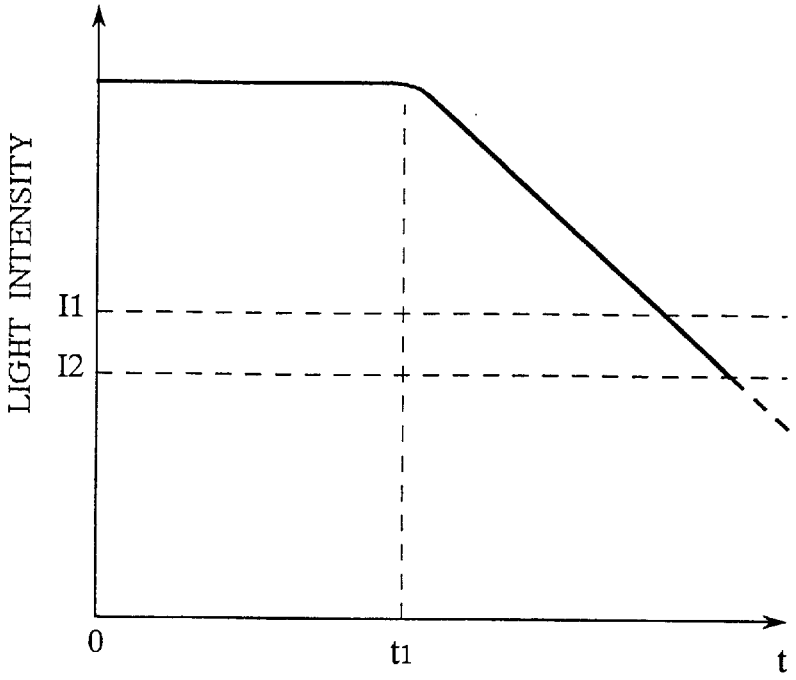
FIG. 13 is a graph showing a relationship between the integral of the length of time that the electric discharge lamp has emitted light since it was attached to the light-emission controlling apparatus shown in FIG. 11 and the intensity of light emitted out of the electric discharge lamp.

Next, a description will be made as to the comparing process performed in step ST1204 with reference to FIG. 13. FIG. 13 shows a relationship between the integral of the length of time that the electric discharge lamp 106 has emitted light since it was attached to the light-emission controlling apparatus and the intensity of light emitted out of the electric discharge lamp 106. In FIG. 13, the horizontal axis shows the integral of the length of time that the electric discharge lamp 106 has emitted light since it was attached to the light-emission controlling apparatus, and the vertical axis shows the intensity of light emitted out of the electric discharge lamp 106. Furthermore, I1 shows the reference light intensity, and I2 shows the minimum value of the light intensity at which the electric discharge lamp 106 can serve a useful function. In general, the time at which the value of the light intensity approaches the minimum value I2 is the time to replace the electric discharge lamp 106. That is, the time at which the value of the light intensity of the electric discharge lamp 106 approaches the minimum value I2 is at the end of its useful life.

In FIG. 13, a horizontal part (0→t1) indicates that the intensity (e.g., 130 lux) of light emitted out of the electric discharge lamp 106 remains constant while it is emitting light. Furthermore, FIG. 13 shows that the light intensity begins to gradually reduce when the integral of the length of time that the electric discharge lamp 106 has emitted light reaches the time t1.

The comparing section 1122 compares the reference light intensity value I1 (e.g., 60 lux) to the value of the current light intensity (e.g., 80 lux) measured by the light-intensity measuring unit 111 so as to determine whether or not the value of the measured light intensity is lower than the reference light intensity value I1. When it is determined, in step ST1204, that the value of the measured light intensity is lower than the reference light intensity value I1, but is greater than the minimum value I2 of the light intensity, the light-emission mode selecting section 1123 furnishes a selecting signal for selecting the second light-emission mode to enable the inverter circuit 104 to cause the electric discharge lamp 106 to flash on and off during a predetermined period of time, i.e., a predetermined number of times. The inverter circuit 104 then in step ST1205 causes the electric discharge lamp 106 to flash on and off during the predetermined period of time according to the selecting signal from the light-emission mode selecting section 1123 through the lighting unit. On the other hand, when it is determined, in step ST1204, that the value of the measured light intensity is greater than or equal to the reference light intensity value I1, the control unit 112 returns to step ST1201 and repeats the above processing After the inverter circuit 104 causes the electric discharge lamp 106 to flash on and off in step ST1205, the comparing section 1122, in step ST1206, furnishes predetermined information about the comparison result obtained in step ST1204 to the display controlling section 1124. After performing step ST1206, the display controlling section 1124, in step ST1207, determines if the display mode selecting switch 502 shown in FIG. 5 is set to the second display mode in which the display unit 501 can display predetermined information about the electric discharge lamp 106 on the screen thereof, by communicating with the sound device 500 through LAN 109.

If the display controlling section 1124, in step ST1207, determines that the display mode selecting switch 502 is set to the second display mode in which predetermined information about the electric discharge lamp 106 can be displayed on the display unit 501, the display controlling section 1124, in step ST1208, furnishes a message about the electric discharge lamp 106 including information about the comparison result from the comparing section 1122, to the sound device 500 by way of LAN 109, and then displays the message on the display unit 501.

After the display controlling section 1124 displays the predetermined information on the display unit 501 in step ST1208, the lighting unit 105 then in step ST1209 determines whether or not the inverter circuit 104 has performed the switching between its on and off states during the predetermined period of time DT (e.g., thirty seconds) so as to cause the electric discharge lamp 106 to flash on and off during the predetermined period of time DT. After performing step ST1209, the control unit 112 advances to steps STl210 to ST1212. The processes in the steps ST1210 to ST1212 are performed similarly to the processes in steps ST210 to ST212 of the first embodiment mentioned above, and therefore the description about the processes in the steps ST1210 to ST1212 will be omitted hereinafter Accordingly, the light-emission control apparatus according to the third embodiment of the present invention makes it possible to, when the value of the measured light intensity of the electric discharge lamp 106 is lower than the reference light intensity value I1, cause the electric discharge lamp 106 to flash on and off during the predetermined period of time and further provide the user with a message informing the user that the time to replace the electric discharge lamp 106 has come, before the light intensity is reduced to its minimum I2, in which case the light-emission state of the electric discharge lamp 106 can be easily made unstable. Therefore, the user can easily realize that the time to replace the electric discharge lamp 106 has come. Furthermore, since the user can easily recognize the current light-emission state of the electric discharge lamp 106 through the display unit, the user can realize, without delay, that the time to replace the electric discharge lamp 106 has come or there is something wrong with the electric discharge lamp 106. Thus the light-emission controlling apparatus can afford more convenience to the user.

Fourth Embodiment

Figure 14:
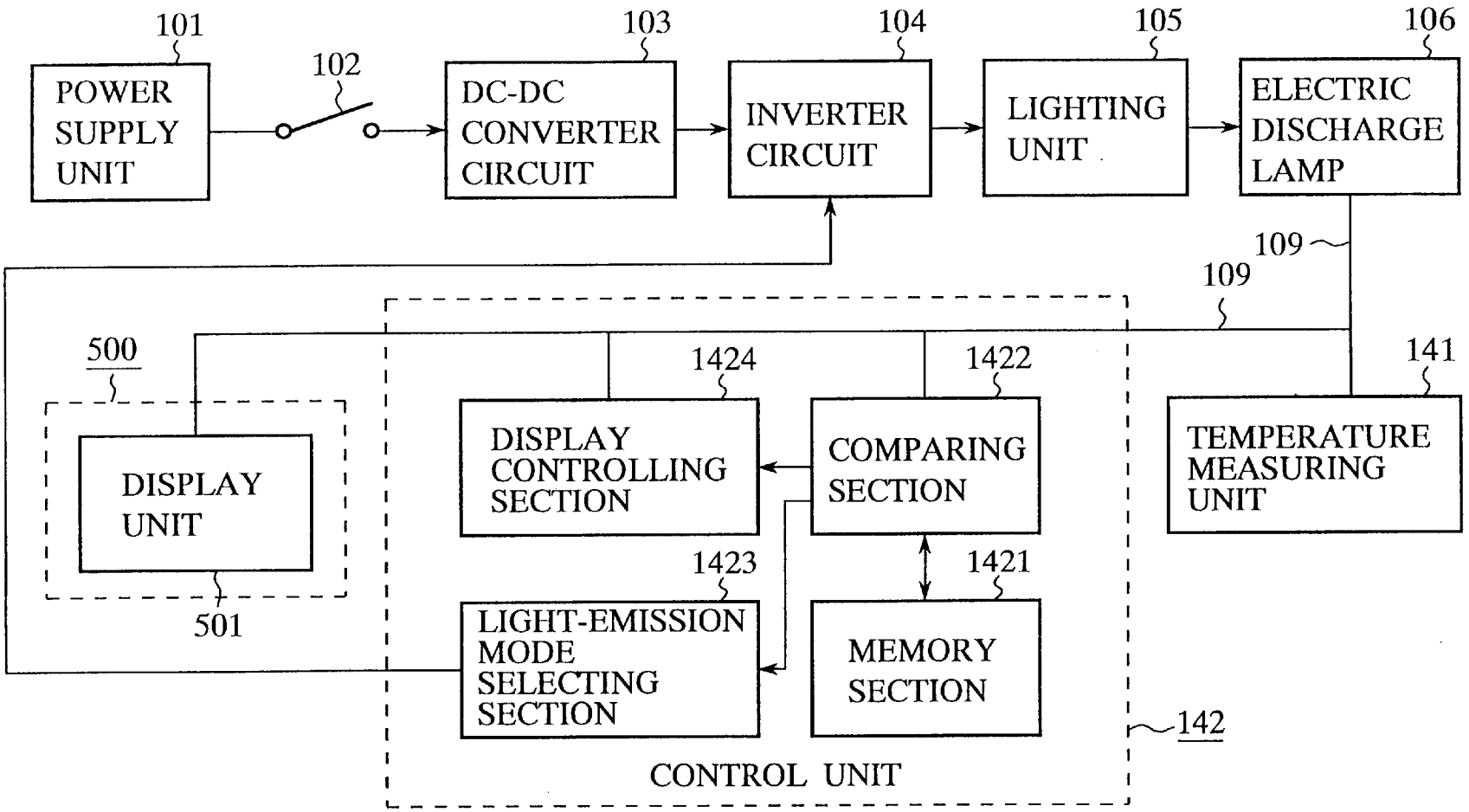
FIG. 14 is a block diagram showing the structure of a light-emission controlling apparatus according to a fourth embodiment of the present invention.

Referring now to FIG. 14, there is illustrated a block diagram showing the structure of a light-emission controlling apparatus according to a fourth embodiment of the present invention. In the figure, the same components as the light-emission controlling apparatus of the above-mentioned first embodiment or like components are designated by the same reference numerals as those in FIG. 1, and therefore the description about the components will be omitted hereinafter.

In FIG. 14, 141 denotes a temperature measuring unit which is disposed as a means for detecting the light-emission state of the electric discharge lamp 106. The temperature measuring unit 147 is adapted to measure ambient temperature in the vicinity of the electric discharge lamp 106 or temperature of the electric discharge lamp 106 while it is emitting light.

Furthermore, reference numeral 142 denotes a control unit provided with a memory section 1421 for prestoring a reference value (e.g., 80° C.) of the ambient temperature in the vicinity of the electric discharge lamp 106, a comparing section 1422 for comparing the ambient temperature showing the light-emission state of the electric discharge lamp 106, which is measured by the temperature measuring unit 141, to the reference value stored in the memory section 1421, a light-emission mode selecting section 1423 for selecting either a first light-emission mode wherein the electric discharge lamp 106 emits light normally (i.e., simply lights up) or a second light-emission mode wherein, for example, the electric discharge lamp 106 flashes on and off during a predetermined period of time, according to the comparison result obtained by the comparing section 1422, to furnish a selecting signal to the inverter circuit 104, so that the inverter circuit 104 enables the lighting unit 105 to light the electric discharge lamp 106, and a display controlling section 1424 for displaying information about the comparison result from the comparing section 1422 on the screen of a display unit 501 of a sound device 500 disposed outside the light-emission controlling apparatus according to the present invention. The light-emission mode selecting section 1423 selects the second light-emission mode when the value of the ambient temperature in the vicinity of the electric discharge lamp 106 measured by the temperature measuring unit 141 exceeds the reference value stored in the memory section 1421. In this specification, the reference value is referred to as the reference ambient temperature value.

The inverter circuit 104 thus enables the lighting unit 105 to cause the electric discharge lamp 106 to emit light in either the first or second light-emission mode according to the selecting signal furnished by the light-emission mode selecting section 1423.

Figure 15:
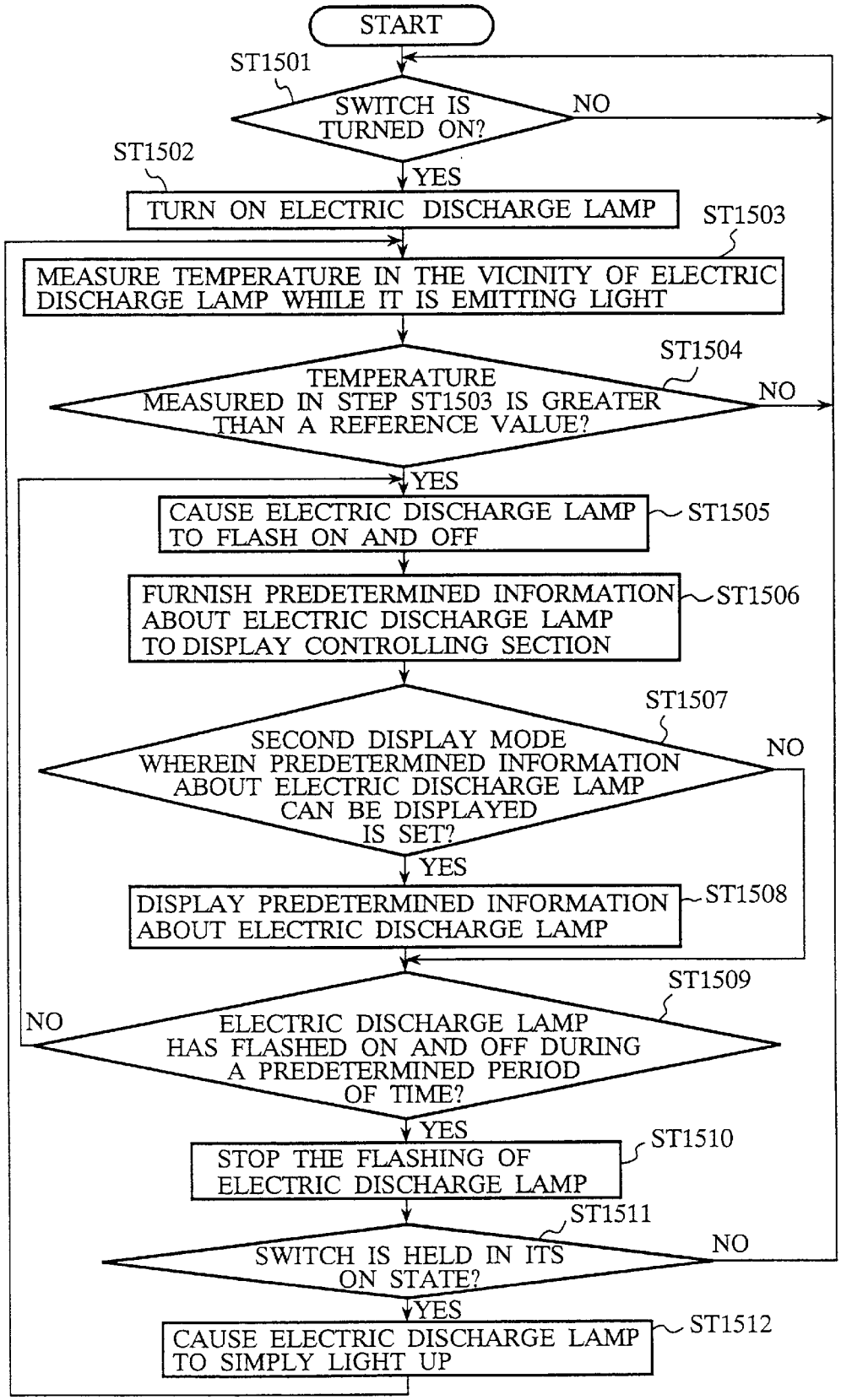
FIG. 15 is a flow diagram showing the operation of the light-emission controlling apparatus shown in FIG. 14.

Referring next to FIG. 15, there is illustrated a flow diagram showing the operation of the light-emission controlling apparatus shown in FIG. 14. Next, a description will be made as to the operation of the light-emission controlling apparatus according to the fourth embodiment of the present invention with reference to FIG. 15. When the user, for example, switches on a switch (not shown), the light-emission controlling apparatus is initiated and the switch 102 is closed, so that the DC—DC converter circuit 103 is coupled to the power supply 101. Then the control unit 142 advances to steps ST1501 and ST1502. The processes performed in steps ST1501 to ST1502 are the same as those performed in steps ST201 to ST202 of the first embodiment mentioned above, and therefore the description about the processes will be omitted hereinafter.

After the inverter circuit 104 enables the electric discharge lamp 106 to emit light in performing step ST1502, the temperature measuring unit 141, in step ST1503, measures ambient temperature in the vicinity of the electric discharge lamp 106. The comparing section 1422 then in step ST1504 acquires the value of the ambient temperature measured in step ST1503 by way of LAN 109 and then compares it to the reference ambient temperature value stored in the storing section 1421.

Figure 16:
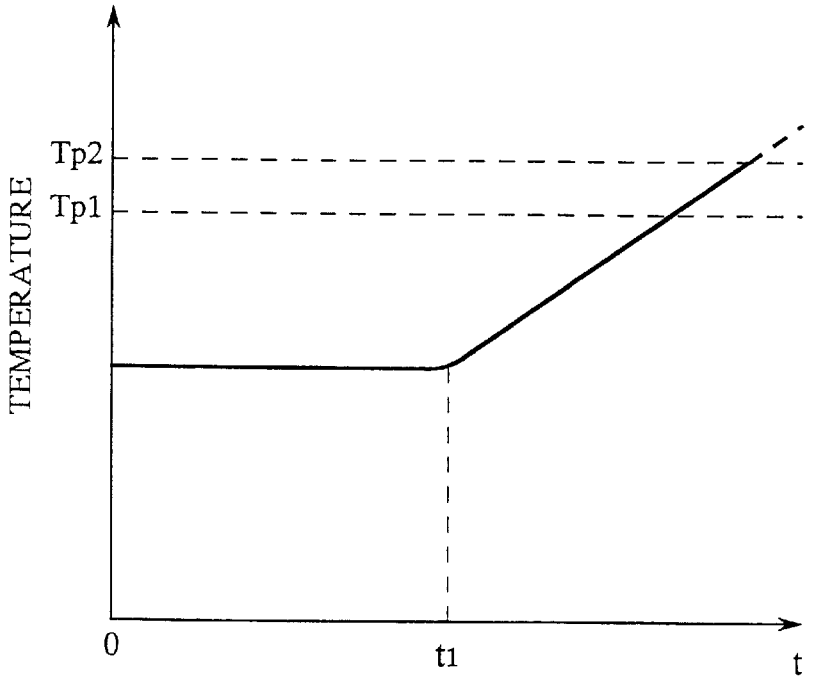
FIG. 16 is a graph showing a relationship between the integral of the length of time that the electric discharge lamp has emitted light since it was attached to the light-emission controlling apparatus shown in FIG. 14 and ambient temperature in the vicinity of the electric discharge lamp.

Next, a description will be made as to the comparing process performed in step ST1504 with reference to FIG. 16. FIG. 16 shows a relationship between the integral of the length of time that the electric discharge lamp 106 has emitted light since it was attached to the light-emission controlling apparatus and the ambient temperature in the vicinity of the electric discharge lamp 106. In FIG. 16, the horizontal axis shows the integral of the length of time that the electric discharge lamp 106 has emitted light since it was attached to the light-emission controlling apparatus, and the vertical axis shows the ambient temperature in the vicinity of the electric discharge lamp 106. Furthermore, Tp1 shows the reference ambient temperature value, and Tp2 shows the maximum value of the ambient temperature at which the electric discharge lamp 106 can serve a useful function. In general, the time at which the value of the ambient temperature approaches the maximum value Tp2 is the time to replace the electric discharge lamp 106. That is, the time at which the value of the ambient temperature in the vicinity of the electric discharge lamp 106 approaches the maximum value Tp2 is at the end of its useful life.

In FIG. 16, a horizontal part (0→t1) indicates that the ambient temperature (e.g., 60° C.) in the vicinity of the electric discharge lamp 106 remains constant while it is emitting light. Furthermore, FIG. 16 shows that the ambient temperature begins to gradually increase when the integral of the length of time that the electric discharge lamp 106 has emitted light reaches the time t1.

The comparing section 1422 in step ST1504 compares the reference ambient temperature value Tp1 (e.g., 100° C.) to the current ambient temperature (e.g., 80° C.) measured by the temperature measuring unit 141 so as to determine whether or not the measured ambient temperature exceeds the reference ambient temperature value Tp1. When it is determined, in step ST1504, that the measured ambient temperature is greater than the reference ambient temperature value Tp1, but is lower than the maximum value Tp2 of the ambient temperature, the light-emission mode selecting section 1423 furnishes a selecting signal for selecting the second light-emission mode to enable the inverter circuit 104 to cause the electric discharge lamp 106 to flash on and off during a predetermined period of time, i.e., a predetermined number of times. The inverter circuit 104 then in step ST1505 causes the electric discharge lamp 106 to flash on and off during the predetermined period of time according to the selecting signal from the light-emission mode selecting section 1423 through the lighting unit. On the other hand, when it is determined, in step ST1504, that the value of the measured ambient temperature does not exceed the reference ambient temperature value Tp1, the control unit 142 returns to step ST1501 and repeats the above processing.

After the inverter circuit 104 causes the electric discharge lamp 106 to flash on and off in step ST1505, the comparing section 1422, in step ST1506, furnishes predetermined information about the comparison result obtained in step ST1504 to the display controlling section 1424. After performing step ST1506, the display controlling section 1424, in step ST1507, determines if the display mode selecting switch 502 shown in FIG. 5 is set to the second display mode in which the display unit 501 can display predetermined information about the electric discharge lamp 106 on the screen thereof, by communicating with the sound device 500 through LAN 109.

If the display controlling section 1424, in step ST1507, determines that the display mode selecting switch 502 is set to the second display mode in which predetermined information about the electric discharge lamp 106 can be displayed on the display unit 501, the display controlling section 1424, in step ST1508, furnishes a message about the electric discharge lamp 106 including information about the comparison result from the comparing section 1422, to the sound device 500 by way of LAN 109, and then displays the message on the display unit 501.

After the display controlling section 1424 displays the predetermined information on the display unit 501 in step ST1508, the lighting unit 105 then in step ST1509 determines whether or not the inverter circuit 104 has performed the switching between its on and off states during the predetermined period of time (e.g., thirty seconds) so as to cause the electric discharge lamp 106 to flash on and off during the predetermined period of time. After performing step ST1509, the control unit 142 advances to steps ST1510 to ST1512. The processes in the steps ST1510 to ST1512 are performed similarly to the processes in steps ST210 to ST212 of the first embodiment mentioned above, and therefore the description about the processes in the steps ST1510 to ST1512 will be omitted hereinafter Accordingly, the light-emission control apparatus according to the fourth embodiment of the present invention makes it possible to, when the value of the measured ambient temperature in the vicinity of the electric discharge lamp 106 exceeds the reference ambient temperature value Tp1, cause the electric discharge lamp 106 to flash on and off during the predetermined period of time and further provide the user with a message informing the user that the time to replace the electric discharge lamp 106 has come, before the measured ambient temperature reaches the maximum value Tp2 of the ambient temperature, in which case the light-emission state of the electric discharge lamp 106 can be easily made unstable. Therefore, the user can easily realize that the time to replace the electric discharge lamp 106 has come. Furthermore, since the user can easily recognize the current light-emission state of the electric discharge lamp 106 through the display unit, the user can realize, without delay, that the time to replace the electric discharge lamp 106 has come or there is something wrong with the electric discharge lamp 106. Thus the light-emission controlling apparatus can afford more convenience to the user.

Fifth Embodiment

Figure 17:
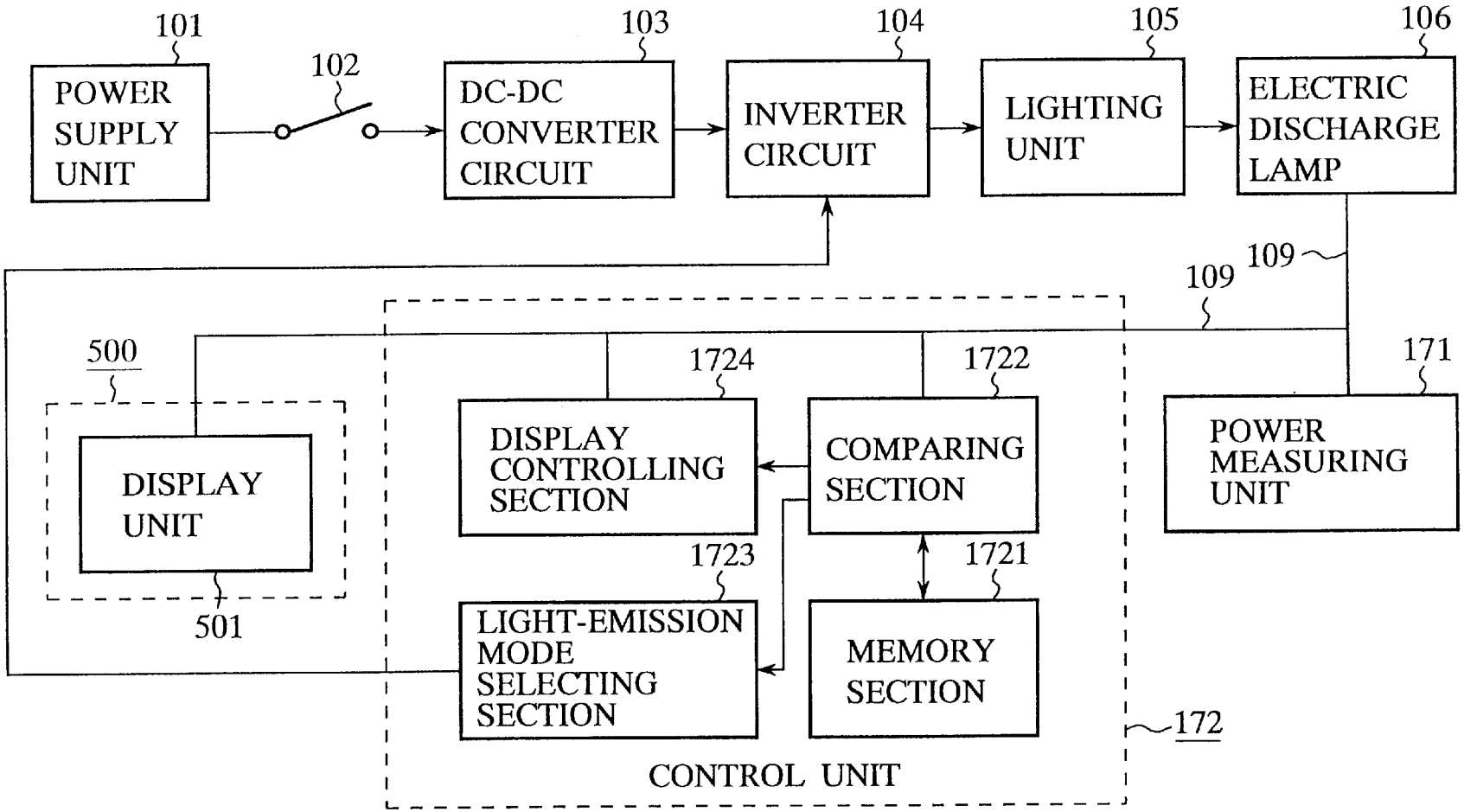
FIG. 17 is a block diagram showing the structure of a light-emission controlling apparatus according to a fifth embodiment of the present invention.

Referring now to FIG. 17, there is illustrated a block diagram showing the structure of a light-emission controlling apparatus according to a fifth embodiment of the present invention. In the figure, the same components as the light-emission controlling apparatus of the above-mentioned first embodiment or like components are designated by the same reference numerals as those in FIG. 1, and therefore the description about the components will be omitted hereinafter.

In FIG. 17, 171 denotes a power measuring unit which is disposed as a means for detecting the light-emission state of the electric discharge lamp 106. The power measuring unit 177 is adapted to measure power supplied to the electric discharge lamp 106 while it is emitting light.

Furthermore, reference numeral 172 denotes a control unit provided with a memory section 1721 for prestoring a reference value (e.g., 60 lux) of the power supplied to the electric discharge lamp 106, a comparing section 1722 for comparing the value of the power showing the light-emission state of the electric discharge lamp 106, which is measured by the power measuring unit 171, to the reference value stored in the memory section 1721, a light-emission mode selecting section 1723 for selecting either a first light-emission mode wherein the electric discharge lamp 106 emits light normally (i.e., simply lights up) or a second light-emission mode wherein, for example, the electric discharge lamp 106 flashes on and off during a predetermined period of time, according to the comparison result obtained by the comparing section 1722, to furnish a selecting signal to the inverter circuit 104, so that the inverter circuit 104 enables the lighting unit 105 to light the electric discharge lamp 106, and a display controlling section 1724 for displaying information about the comparison result from the comparing section 1722 on the screen of a display unit 501 of a sound device 500 disposed outside the light-emission controlling apparatus according to the present invention. The light-emission mode selecting section 1723 selects the second light-emission mode when the power supplied to the electric discharge lamp 106 measured by the power measuring unit 171 exceeds the reference value stored in the memory section 1721. In this specification, the reference value is referred to as the reference power value.

The inverter circuit 104 thus enables the lighting unit 105 to cause the electric discharge lamp 106 to emit light in either the first or second light-emission mode according to the selecting signal furnished by the light-emission mode selecting section 1723.

Figure 18:
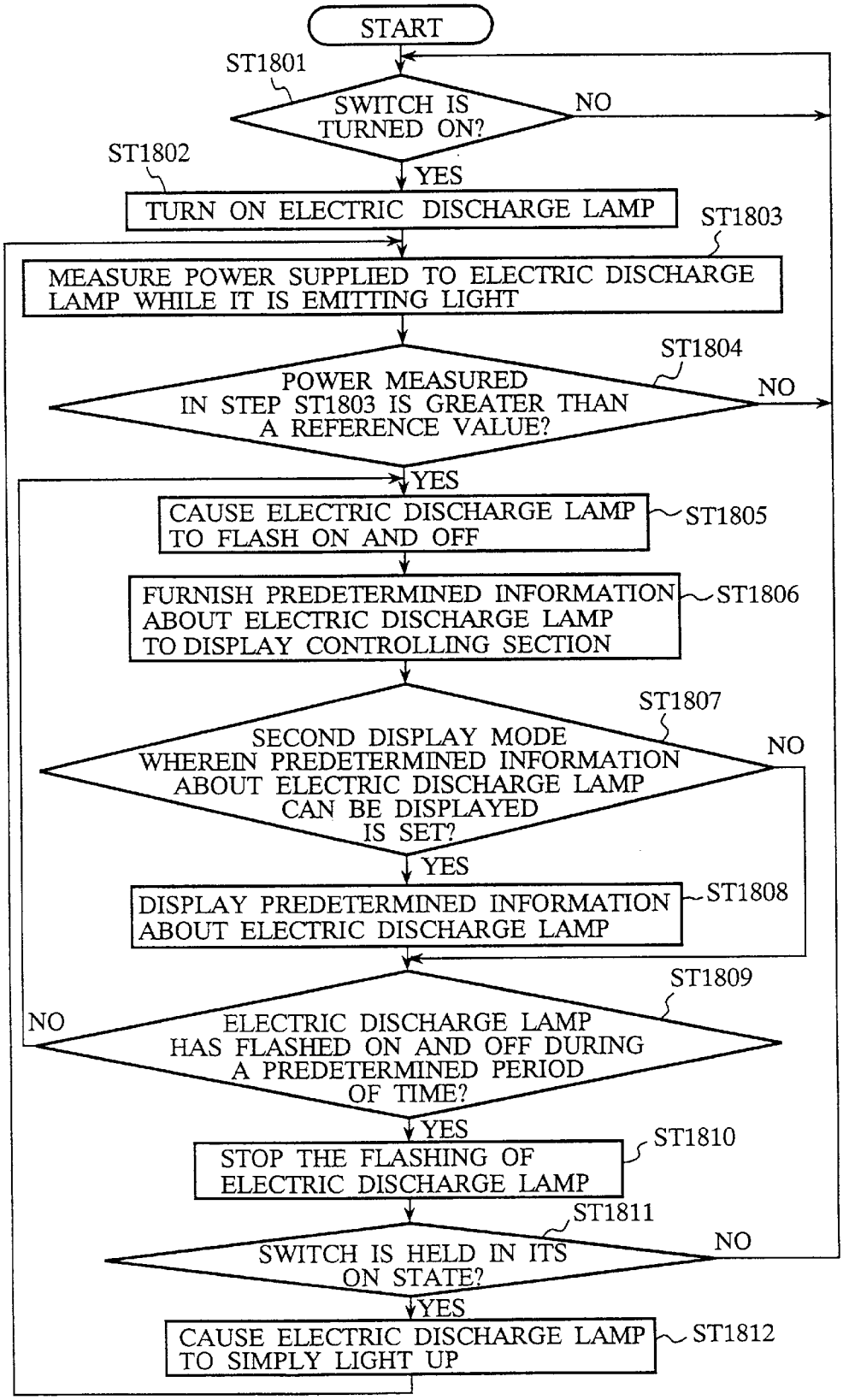
FIG. 18 is a flow diagram showing the operation of the light-emission controlling apparatus shown in FIG. 17.

Referring next to FIG. 18, there is illustrated a flow diagram showing the operation of the light-emission controlling apparatus shown in FIG. 17. Next, a description will be made as to the operation of the light-emission controlling apparatus according to the fifth embodiment of the present invention with reference to FIG. 18. When the user, for example, switches on a switch (not shown), the light-emission controlling apparatus is initiated and the switch 102 is closed, so that the DC—DC converter circuit 103 is coupled to the power supply 101. Then the control unit 172 advances to steps ST1801 and ST1802. The processes performed in steps ST1801 to ST1802 are the same as those performed in steps ST201 to ST202 of the first embodiment mentioned above, and therefore the description about the processes will be omitted hereinafter.

After the inverter circuit 104 enables the electric discharge lamp 106 to emit light in performing step ST1802, the power measuring unit 171, in step ST1803, measures the power supplied to the electric discharge lamp 106. The comparing section 1722 then in step ST1804 acquires the value of the power measured in step ST1803 by way of LAN 109, and then compares it to the reference power value stored in the storing section 1721.

Figure 19:
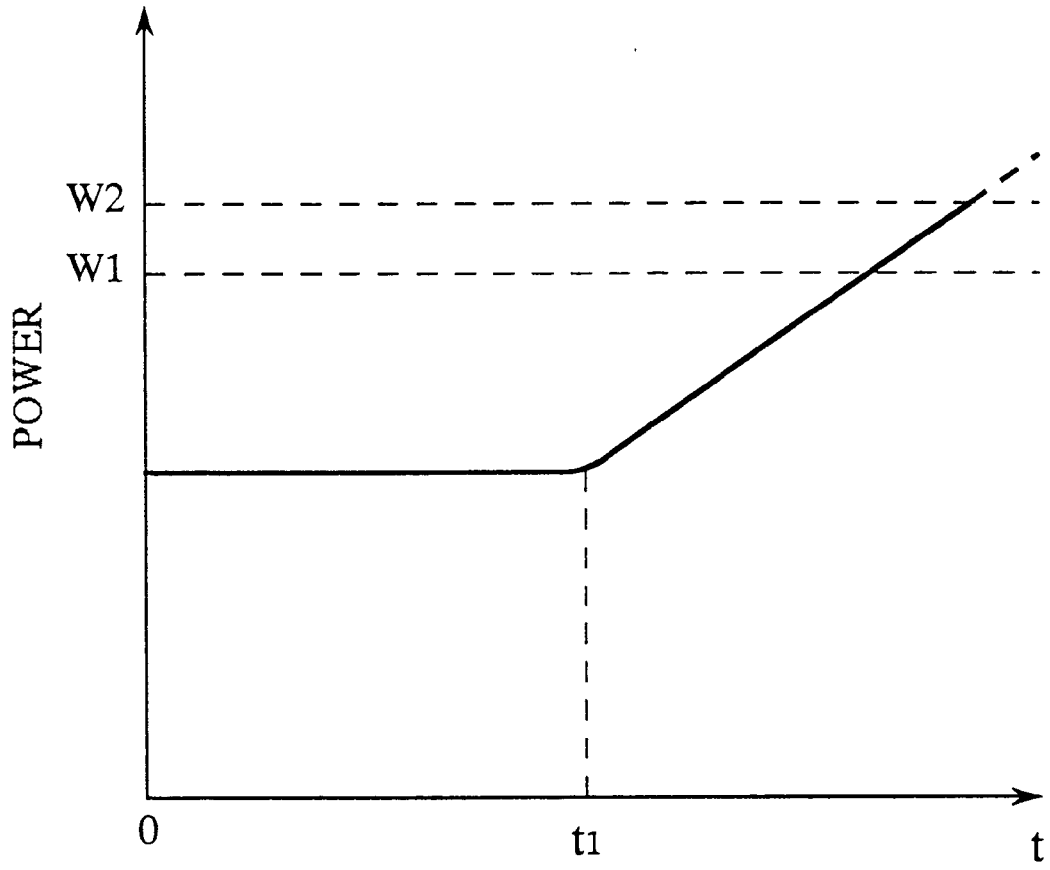
FIG. 19 is a graph showing a relationship between the integral of the length of time that the electric discharge lamp has emitted light since it was attached to the light-emission controlling apparatus shown in FIG. 17 and power supplied to the electric discharge lamp.

Next, a description will be made as to the comparing process performed in step ST1804 with reference to FIG. 19. FIG. 19 shows a relationship between the integral of the length of time that the electric discharge lamp 106 has emitted light since it was attached to the light-emission controlling apparatus and the power supplied to the electric discharge lamp 106. In FIG. 19, the horizontal axis shows the integral of the length of time that the electric discharge lamp 106 has emitted light since it was attached to the light-emission controlling apparatus, and the vertical axis shows the power supplied to the electric discharge lamp 106. Furthermore, W1 shows the reference power value, and W2 shows the maximum value of the power at which the electric discharge lamp 106 can serve a useful function. In general, the time at which the value of the power approaches the maximum value W2 is the time to replace the electric discharge lamp 106. That is, the time at which the value of the power supplied to the electric discharge lamp 106 approaches the maximum value W2 is at the end of its useful life.

In FIG. 19, a horizontal part (0→t1) indicates that the power (e.g., 60 W) supplied to the electric discharge lamp 106 remains constant while it is emitting light. Furthermore, FIG. 19 shows that the power begins to gradually increase when the integral of the length of time that the electric discharge lamp 106 has emitted light reaches the time t1.

The comparing section 1722 compares the reference power value W1 (e.g., 100 W) to the current power supplied to the electric discharge lamp (e.g., 80 W) measured by the power measuring unit 171 so as to determine whether or not the value of the measured power exceeds the reference power value W1. When it is determined, in step ST1804, that the value of the measured power is greater than the reference power value W1, but is lower than the maximum value W2 of the power supplied to the electric discharge lamp, the light-emission mode selecting section 1723 furnishes a selecting signal for selecting the second light-emission mode to enable the inverter circuit 104 to cause the electric discharge lamp 106 to flash on and off during a predetermined period of time, i.e., a predetermined number of times. The inverter circuit 104 then in step ST1805 causes the electric discharge lamp 106 to flash on and off during the predetermined period of time according to the selecting signal from the light-emission mode selecting section 1723 through the lighting unit On the other hand, when it is determined, in step ST1804, that the measured power does not exceed the reference power value W1, the control unit 172 returns to step ST1801 and repeats the above processing.

After the inverter circuit 104 causes the electric discharge lamp 106 to flash on and off in step ST1805, the comparing section 1722, in step ST1806, furnishes predetermined information about the comparison result obtained in step ST1804 to the display controlling section 1724. After performing step ST1806, the display controlling section 1724, in step ST1807, determines if the display mode selecting switch 502 shown in FIG. 5 is set to the second display mode in which the display unit 501 can display predetermined information about the electric discharge lamp 106 on the screen thereof, by communicating with the sound device 500 through LAN 109.

If the display controlling section 1724, in step ST1807, determines that the display mode selecting switch 502 is set to the second display mode in which predetermined information about the electric discharge lamp 106 can be displayed on the display unit 501, the display controlling section 1724, in step ST1808, furnishes a message about the electric discharge lamp 106 including information about the comparison result from the comparing section 1722, to the sound device 500 by way of LAN 109, and then displays the message on the display unit 501.

After the display controlling section 1724 displays the predetermined information on the display unit 501 in step ST1808, the lighting unit 105 then in step ST1809 determines whether or not the inverter circuit 104 has performed the switching between its on and off states during the predetermined period of time (e.g., thirty seconds) so as to cause the electric discharge lamp 106 to flash on and off during the predetermined period of time. After performing step ST1809, the control unit 172 advances to steps ST1810 to ST1812. The processes in the steps ST1810 to ST1812 are performed similarly to the processes in steps ST210 to ST212 of the first embodiment mentioned above, and therefore the description about the processes in the steps ST1810 to ST1812 will be omitted hereinafter A variant may be made in the exemplary embodiment Instead of the power measuring unit 171 for measuring power supplied to the electric discharge lamp 106, there is provided a unit for measuring a voltage applied to the electric discharge lamp 106, i.e., a voltage across the electric discharge lamp. The voltage applied to the electric discharge lamp 106 is increased similarly to the power supplied to the electric discharge lamp when the integral of the length of time that the electric discharge lamp has emitted light reaches the time t1, as shown in FIG. 19. Thus, by determining whether or not the voltage measured by the voltage measuring unit exceeds its corresponding reference value, the control unit 172 enables the inverter circuit 104 to cause the electric discharge lamp 106 to emit light in the first or second light-emission mode selected.

Accordingly, the light-emission control apparatus according to the fifth embodiment of the present invention makes it possible to, when the measured power supplied to the electric discharge lamp 106 exceeds the reference power value W1, cause the electric discharge lamp 106 to flash on and off during the predetermined period of time and further provide the user with a message informing the user that the time to replace the electric discharge lamp 106 has come, before the measured power reaches the maximum value W2 of the power, in which case the light-emission state of the electric discharge lamp 106 can be easily made unstable. Therefore, the user can easily realize that the time to replace the electric discharge lamp 106 has come. Furthermore, since the user can easily recognize the current light-emission state of the electric discharge lamp 106 through the display unit, the user can realize, without delay, that the time to replace the electric discharge lamp 106 has come or there is something wrong with the electric discharge lamp 106. Thus the light-emission controlling apparatus can afford more convenience to the user.

Sixth Embodiment

A light-emission controlling apparatus according to a sixth embodiment of the present invention comprises the same light-emission time integrating unit 107 as the above-mentioned first embodiment, the same light-emission number counting unit 701 as the above-mentioned second embodiment, the same light-intensity measuring unit 111 as the above-mentioned third embodiment, the same temperature measuring unit 141 as the above-mentioned fourth embodiment, and the same power measuring unit 171 as the above-mentioned fifth embodiment. The light-emission controlling apparatus is adapted to select one from among a plurality of light-emission modes by respectively comparing the measured integral of the length of time that the electric discharge lamp 106 has emitted light since it was attached to the light-emission controlling apparatus, the measured number of times that the electric discharge lamp 106 has emitted light since it was attached to the light-emission controlling apparatus, the measured intensity of light emitted out of the electric discharge lamp 106, the measured ambient temperature in the vicinity of the electric discharge lamp 106, and the measured power supplied to the electric discharge lamp 106, to their corresponding reference values, and then cause the electric discharge lamp 106 to emit light in the selected light-emission mode.

Figure 20:
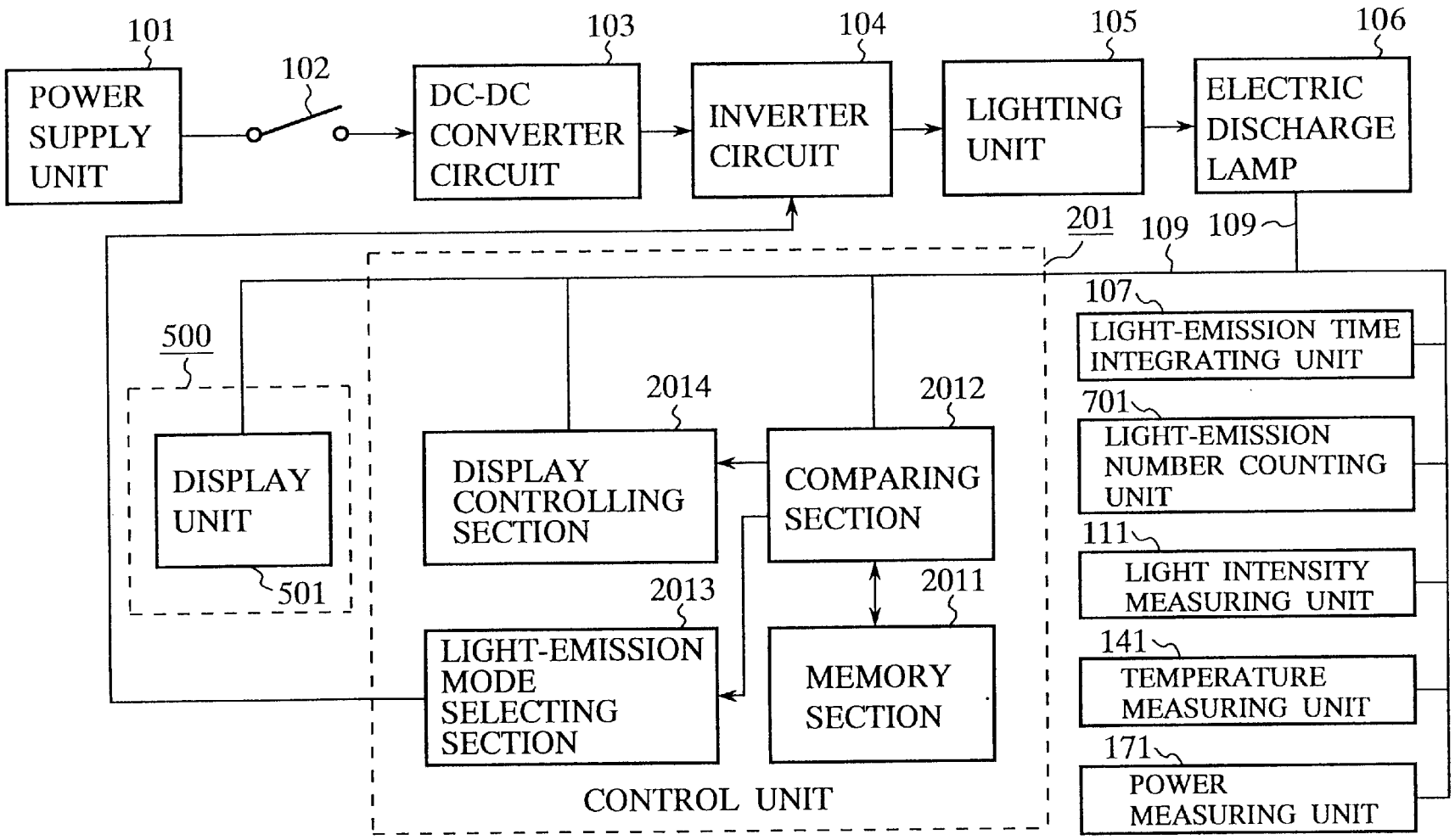
FIG. 20 is a block diagram showing the structure of a light-emission controlling apparatus according to a sixth embodiment of the present invention.

Referring next to FIG. 20, there is illustrated a block diagram showing the structure of a light-emission controlling apparatus according to the sixth embodiment of the present invention. In the figure, the same components as the light-emission controlling apparatuses of the above-mentioned first to fifth embodiments or like components are designated by the same reference numerals as those in FIGS. 1, 7, 11, 14 and 17, and therefore the description about the components will be omitted hereinafter.

In FIG. 20, reference numeral 201 denotes a control unit provided with a memory section 2011 for prestoring a plurality of reference values, each showing the current light-emission state of the electric discharge lamp 106, of the integral of the length of time that the electric discharge lamp 106 has emitted light since it was attached to the light-emission control apparatus, the number of times that the electric discharge lamp 106 has emitted light since it was attached to the light-emission control apparatus, the intensity of light emitted out of the electric discharge lamp 106, the ambient temperature in the vicinity of the electric discharge lamp 106, and the power supplied to the electric discharge lamp 106, a comparing section 2012 for respectively comparing the measurement results by the light-emission time integrating unit 107, the light-emission number counting unit 701, the light-intensity measuring unit 111, the temperature measuring unit 141, and the power measuring unit 171, to the plurality of reference values stored in the memory section 2011, a light-emission mode selecting section 2013 for selecting one from among a plurality of light-emission modes according to the comparison results obtained by the comparing section 2212, to furnish a selecting signal to the inverter circuit 104 so as to light the electric discharge lamp 106 in the selected light-emission mode, and a display controlling section 2014 for displaying information about the comparison results from the comparing section 2012 on a display unit 501 of a sound device 500 disposed outside the light-emission controlling apparatus according to the present invention.

The light-emission time integrating unit 107, the light-emission number counting unit 701, the light-intensity measuring unit 111, the temperature measuring unit 141, and the power measuring unit 171 are adapted to be able to communicate with the control unit 201 by way of LAN 109.

In operation, when the user, for example, switches on a switch (not shown), the switch 102 is closed and therefore the DC—DC converter circuit 103 is coupled to the power supply unit 101. After that, the light-emission time integrating unit 107 measures the integral of the length of time that the electric discharge lamp 106 has emitted light since it was attached to the light-emission controlling apparatus, like the above-mentioned first embodiment. In addition, the light-emission number counting unit 701 measures the number of times that the electric discharge lamp 106 has emitted light since it was attached to the light-emission controlling apparatus, like the above-mentioned second embodiment. Furthermore, the light-intensity measuring unit 111 directly or indirectly measures the intensity of light emitted out the electric discharge lamp 106, the temperature measuring unit 141 measures ambient temperature in the vicinity of the electric discharge lamp 106, and the power measuring unit 171 measured power supplied to the electric discharge lamp 106. Then the comparing section 2012 compares the measured light-emission integrated time, the measured light-emission number of times, the measured light intensity, the measured ambient temperature, and the measured power, to their corresponding reference values, respectively, and furnishes comparison results to the light-emission mode selecting section 2013.

The light-emission mode selecting section 2013 selects the first light-emission mode and furnishes a selecting signal to cause the electric discharge lamp 106 to simply light up to the inverter circuit 104 if these comparison results indicate that all of the measured light-emission integrated time, the measured light-emission number of times, the measured light intensity, the measured ambient temperature, and the measured power do not reach their reference values, respectively. On the contrary, the light-emission mode selecting section 2013 selects the second light-emission mode in which the inverter circuit 104 causes the electric discharge lamp 106 to flash on and off during a predetermined period of time, otherwise That is, if the measured light-emission integrated time exceeds the reference light-emission integrated time, the measured light-emission number of times exceeds the reference light-emission number of times, the value of the measured light intensity is lower than the reference light-intensity value, the value of the measured ambient temperature is greater than the reference temperature value, or the value of the measured power is greater than the reference power value, the light-emission mode selecting section 2013 selects the second light-emission mode and furnishes a selecting signal to cause the electric discharge lamp 106 to flash on and off during a predetermined period of time, i.e., only a predetermined number of times, e.g., only three times, to the inverter circuit 104. After that, when the display controlling section 2014 determines that the display mode selecting switch 502 is set to the second display mode in which predetermined information about the electric discharge lamp 106 can be displayed on the display unit 501, the display controlling section 2014 furnishes a message about the electric discharge lamp 106 including information about the comparison results to the sound device 500 by way of LAN 109, and then displays the message on the display unit 501. For example, the display controlling section 2014 displays a message as shown in FIG. 6*a* or 6*b* on the display unit 501. In addition, the display controlling section 2014 can display a message about the light intensity, ambient temperature, or power, on the display unit 501. Then the control unit 201 operates like the first embodiment mentioned above.

Numerous variants may be made in this exemplary embodiment. As an example, according to whether the measured light-emission integrated time exceeds the reference light-emission integrated time, the measured light-emission number of times exceeds the reference light-emission number of times, the value of the measured light intensity is lower than the reference light intensity value, the value of the measured ambient temperature is greater than the reference temperature value, or the value of the measured power is greater than the reference power value, the light-emission mode selecting section 2013 can select a different light-emission mode. For example, if the measured light-emission integrated time exceeds the reference light-emission integrated time, the light-emission mode selecting section 2013 selects a second light-emission mode and furnishes a selecting signal to cause the electric discharge lamp 106 to flash on and off only a predetermined number of times, e.g., only three times, to the inverter circuit 104. On the other hand, if the measured light-emission number of times exceeds the reference light-emission number of times, the light-emission mode selecting section 2013 selects a third light-emission mode and furnishes a selecting signal to cause the electric discharge lamp 106 to flash on and off only another predetermined number of times, e.g., only five times, to the inverter circuit 104. Accordingly, the user can easily determine which one of the plural pieces of information such as the integral of the length of time that the electric discharge lamp has emitted light, the number of times that the electric discharge lamp has emitted light, the intensity of light emitted out of the electric discharge lamp, the ambient temperature in the vicinity of the electric discharge lamp, and the power supplied to the electric discharge lamp, each of which shows the light-emission state of the electric discharge lamp 106, caused the generation of the warning, on the basis of, for example, a number of times that the electric discharge lamp 106 had flashed on and off. Therefore, the user can easily realize that the time to replace the electric discharge lamp 106 has come or that there is something wrong with the electric discharge lamp 106.

As previously mentioned, the light-emission controlling apparatus according to the sixth embodiment of the present invention can show that an abnormal condition is encountered in the electric discharge lamp 106 more specifically. Accordingly, this ensures that the user can realize a malfunction in the electric discharge lamp 106. The reliability of the light-emission controlling apparatus is thus improved.

Seventh Embodiment

Figure 21:
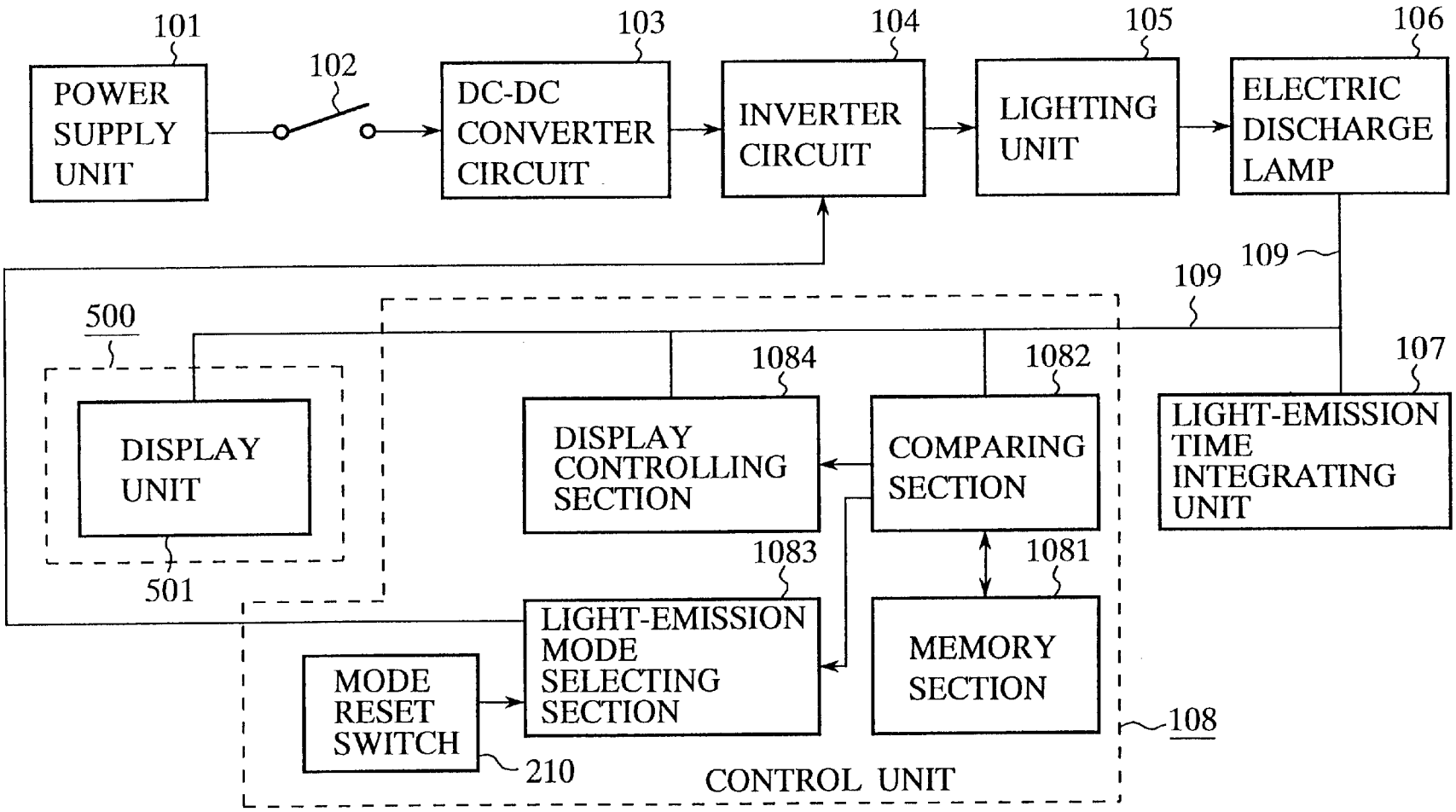
FIG. 21 is a block diagram showing the structure of a light-emission controlling apparatus according to a seventh embodiment of the present invention.
Figure 22:
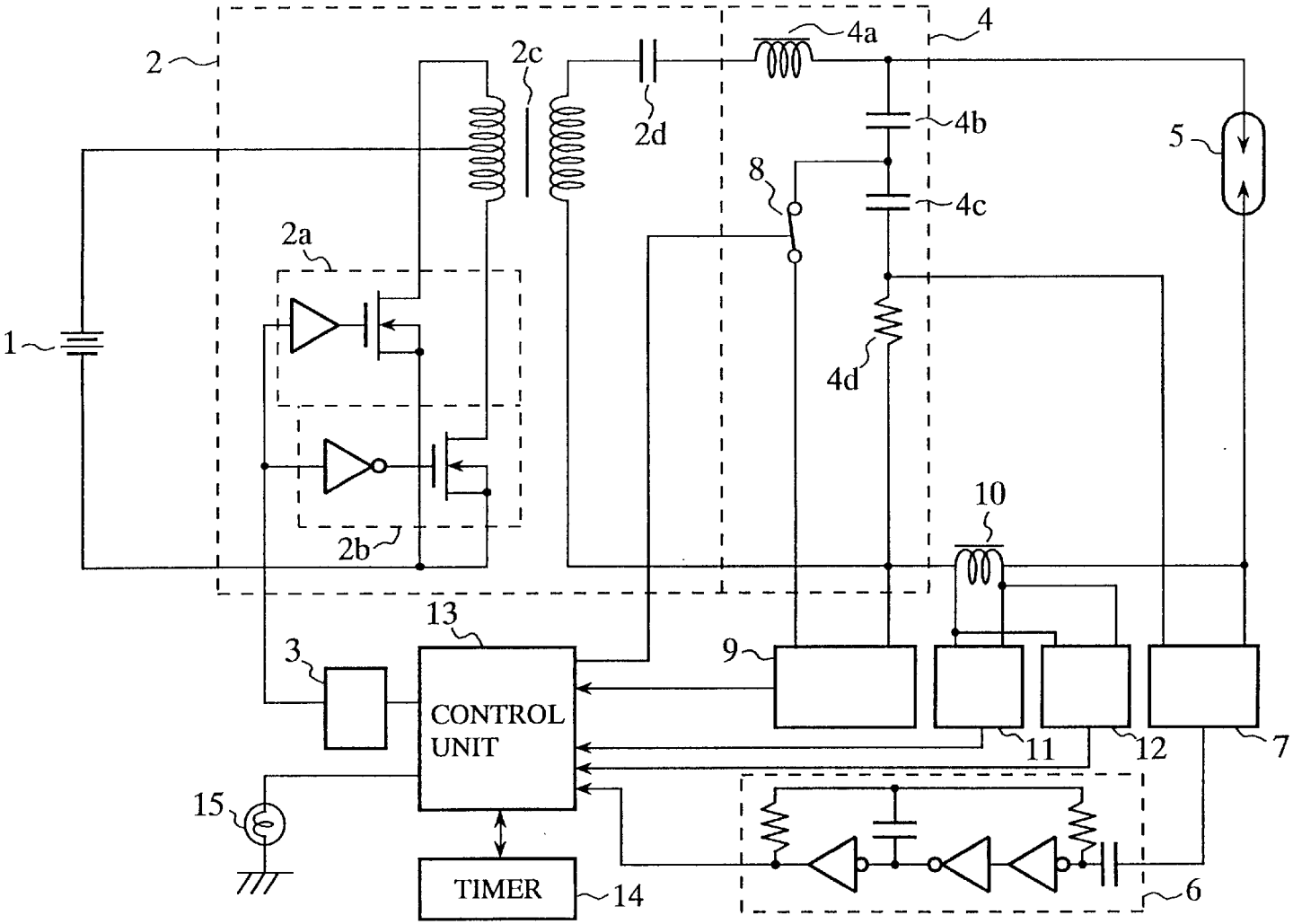
FIG.22(PRIOR ART)
FIG. 22 is a schematic diagram showing the structure of a prior art light-emission controlling apparatus.

Referring next to FIG. 21, there is illustrated a block diagram showing the structure of a light-emission controlling apparatus according to a seventh embodiment of the present invention. In the figure, the same components as the light-emission controlling apparatus of the above-mentioned first embodiment or like components are designated by the same reference numerals as those in FIG. 1, and therefore the description about the components will be omitted hereinafter. In FIG. 21, reference numeral 210 denotes a mode reset switch, which is enabled by a user's operation, for causing the electric discharge lamp 106 which is flashing on and off in the second light-emission mode to change to the first light-emission mode in which the electric discharge lamp 106 simply lights up.

Since the basic operation of the light-emission controlling apparatus of this embodiment is the same as that of the light-emission controlling apparatus of the above-mentioned first embodiment, a description will be made as to only a difference between the seventh and first embodiments. When the light-emission mode selecting section 1083 selects the second light-emission mode, the inverter circuit 104 causes the electric discharge lamp 106 to flash on and off only a predetermined number of times through the lighting unit 105 in response to the selecting signal from the light-emission mode selecting section 1083. At that time, if the user realizes that the electric discharge lamp 106 is emitting light in the second light-emission mode and then actuates the mode reset switch 210, the light-emission mode selecting section 1083 furnishes a selecting signal to select the first light-emission mode to the inverter circuit 104 before the electric discharge lamp 106 finishes flashing on and off only a predetermined number of times. As a result, the electric discharge lamp 106 switches from the second light-emission mode to the first light-emission mode in which the electric discharge lamp 106 simply lights up.

Accordingly, since the light-emission controlling apparatus according to the seventh embodiment of the present invention can switch the electric discharge lamp 106 from the second light-emission mode to the first light-emission mode in which the electric discharge lamp 106 simply lights up when the user actuates the mode reset switch 210, the light-emission controlling apparatus can afford more convenience to the user. It is needless to say that the light-emission controlling apparatus according to any one of the above-mentioned second to sixth embodiments can comprise the mode reset switch 210 of the this embodiment.

Numerous variants may be made in the plurality of exemplary embodiments mentioned above. It is clear in particular that instead of the sound device 500 connected to LAN 109 and provided with the display unit 501 which can serve to display information about the electric discharge lamp 106, any equipment which can be connected to LAN 109 and comprises a display unit may suffice. This variant can offer the same advantage as that offered by any one of the above-mentioned embodiments.

It is also clear that instead of causing the electric discharge lamp 106 to flash on and off only a predetermined number of times so as to warn the user that, for example, the measured integral of the length of time that the electric discharge lamp 106 has emitted light exceeds the reference light-emission integrated time when the light-emission mode selecting section selects the second light-emission mode, any method of warning the user by controlling the light-emission state of the electric discharge lamp 106 other than causing the electric discharge lamp 106 to simply light up may suffice. For example, it is preferable to hold the electric discharge lamp 106 in its off state during a predetermined period of time after the switch 102 is turned on. Thus the user can easily realize that, for example, the time to replace the electric discharge lamp 106 has come.

It would also be possible to cause another light emitting means (not shown) other than the electric discharge lamp 106, the light-emission state of which has been detected by the detecting means such the light-emission time integrating unit, to light up, that is, cause the electric discharge lamp 106 to simultaneously light the other light-emitting means disposed in the vicinity of the electric discharge lamp 106. Alternatively, the control unit can switch off the electric discharge lamp 106 and then light the other light-emitting means disposed in the vicinity of the electric discharge lamp 106. For example, an electric discharge lamp used for low beam is turned off, and simultaneously an electric discharge lamp used for high beam is turned on. In the variant so constructed, the other light-emitting means can take the place of the electric discharge lamp 106 automatically and temporarily. Thus the variant can afford more convenience to the user.

It is also apparent that instead of furnishing a selecting signal to the inverter circuit 104 when the light-emission mode selecting section selects one light-emission mode of the electric discharge lamp 106, the light-emission mode selecting section could furnish a control signal which corresponds to the selected light-emission mode to the switch 102 so as to cause the electric discharge lamp 106 to emit light in the selected light-emission mode. The variant so constructed can offer the same advantage as those provided by the above first to seventh embodiments.

As previously explained, the present invention offers the following advantages.

In accordance with a preferred embodiment of the present invention, there is provided a light-emission controlling apparatus comprising a light-emitting device for emitting light such as an electric discharge device, a detecting unit for detecting a light-emission state of the light-emitting device, a comparing unit for comparing the light-emission state of the light-emitting device detected by the detecting unit to a reference light-emission state of the light-emitting device, a light-emission mode selecting unit for selecting either a first light-emission mode wherein the light-emitting device simply lights up or a second light-emission mode wherein the light-emitting device flashes on and off during a predetermined time period according to a comparison result from the comparing unit so as to cause the light-emitting device to emit light in the selected light-emission mode, and a local area network through with information about the detected light-emission state of the light-emitting device. Accordingly, the light-emission control apparatus according to this embodiment of the present invention makes it possible to cause the light-emitting device to, for example, flash on and off during a predetermined period of time by detecting the light-emission state of the light-emitting device so as to inform the user that, for example, the time to replace the light-emitting device has come. Therefore, the user can easily realize that the time to replace the light-emitting device has come. The improvement of this embodiment thus increases the reliability of the light-emission controlling apparatus.

The control unit can display the information about the light-emission state of the light-emitting device on the display device disposed outside the light-emission controlling apparatus. That is, the control unit makes the information about the light-emission state of the light-emitting device visible. Accordingly, the user can easily realize the information about the light-emission state of the light-emitting device displayed on the display device.

In accordance with another preferred embodiment of the present invention, the detecting unit detects the light-emission state of the light-emitting device by measuring the integral of the length of time that the light-emitting device has emitted light since it was attached to the light-emission controlling apparatus, or counting the number of times that the light-emitting device has emitted light since it was attached to the light-emission controlling apparatus. Therefore, the light-emission controlling apparatus can cause the light-emitting device to emit light in a light-emission mode selected according to either the measured light-emission integrated time or the counted light-emission number of times. Thus the light-emission state of the light-emitting device can be controlled more finely.

In accordance with another preferred embodiment of the present invention, the detecting unit detects the light-emission state of the light-emitting device by measuring the intensity of light emitted out of the light-emitting device, temperature of the light-emitting device, power supplied to the light-emitting device, or a voltage applied to the light-emitting device, which shows the light-emission state of the light-emitting device. Thus the light-emission state of the light-emitting device can be controlled more finely.

In accordance with another preferred embodiment of the present invention, the light-emission controlling apparatus can select one light-emission mode according to which one of the integral of the length of time that the light-emitting device has emitted light, the number of times that the light-emitting device has emitted light, the light intensity of the light-emitting device, and so on, exceeds the corresponding reference value, and cause the light-emitting device to emit light in the selected light-emission mode to generate a warning. Therefore, the user can easily determine which one of the plural pieces of information such as the integrated light-emission time, the light-emission number of times, the light intensity, and so on, each of which shows the light-emission state of the light-emitting device, generated the warning, on the basis of, for example, a number of times that the light-emitting device had flashed on and off.

In accordance with another preferred embodiment of the present invention, when the light-emission mode selecting unit selects the second light-emission mode, the control unit causes another light-emitting device other than the light-emitting device the light-emission state of which is detected by the detecting unit to emit light. The other light-emitting device can take the place of the first light-emitting device automatically. Accordingly, this eliminates the inconvenience of switching the first light-emitting device to the second light-emitting device. Thus the embodiment can afford more convenience to the user.

Many widely different embodiments of the present invention may be constructed without departing from the spirit and scope of the present invention. It should be understood that the present invention is not limited to the specific embodiments described in the specification, except as defined in the appended claims.

What is claimed is:

1. A light-emission controlling apparatus comprising:

a light-emitting means for emitting light;

a detecting means for detecting a light-emission state of said light-emitting means;

a control means for selecting one from at least a first light-emission mode and a second light-emission mode according to the light-emission state of said light-emitting means detected by said detecting means, and for enabling said light-emitting means to emit light in the selected first or second light-emission mode; and a communications means through which information about the light-emission state of said light-emitting means detected by said detecting means is transmitted.

2. The light-emission controlling apparatus according to claim 1, wherein said control means includes a comparing means for comparing the light-emission state of said light-emitting means detected by said detecting means to a reference light-emission state of said light-emitting means, and a light-emission mode selecting means for selecting one from the plurality of light-emission modes according to a comparison result from said comparing means.

3. The light-emission controlling apparatus according to claim 2, wherein said control means includes a means for transmitting information about the comparison result from said comparing means, as the information about the light-emission state of said light-emitting means, to a display device disposed outside said light-emission controlling apparatus by way of said communications means, and for displaying the information about the comparison result on the display device.

4. The light-emission controlling apparatus according to claim 3, wherein said detecting means detects the light-emission state of said light-emitting means by acquiring information showing how long or how many times said light-emitting means has been used.

5. The light-emission controlling apparatus according to claim 4, wherein said detecting means includes a means for measuring the integral of the length of time that said light-emitting means has emitted light since it was attached to said light-emission controlling apparatus, and said comparing means compares the measured integral of the length of time that said light-emitting means has emitted light to a reference value showing the reference light-emission state of said light-emitting means, and wherein said light-emission mode selecting means selects the second light-emission mode when the comparison result indicates that the measured integral of the length of time that said light-emitting means has emitted light is greater than the reference value, and said light-emission mode selecting means selects the first light-emission mode otherwise.

6. The light-emission controlling apparatus according to claim 4, wherein said detecting means includes a means for measuring or counting the number of times that said light-emitting means has emitted light since it was attached to said light-emission controlling apparatus, and said comparing means compares the measured number of times that said light-emitting means has emitted light to a reference value showing the reference light-emission state of said light-emitting means, and wherein said light-emission mode selecting means selects the second light-emission mode when the comparison result indicates that the measured number of times that said light-emitting means has emitted light is greater than the reference value, and said light-emission mode selecting means selects the first light-emission mode otherwise.

7. The light-emission controlling apparatus according to claim 4, wherein said detecting means includes a means for measuring intensity of light emitted out of said light-emitting means, temperature of said light-emitting means or ambient temperature in the vicinity of said light-emitting means, power supplied to said light-emitting means, or a voltage applied to said light-emitting means, and said comparing means compares the measurement result by said measuring means to a corresponding reference value showing the reference light-emission state of said light-emitting means, and wherein said light-emission mode selecting means selects the second light-emission mode when the comparison result indicates that the value of the measured light intensity is lower than its corresponding reference value, the value of the measured temperature is greater than its corresponding reference value, the value of the measured power is greater than its corresponding reference value, or the value of the measured voltage is greater than its corresponding reference value, and said light-emission mode selecting means selects the first light-emission mode otherwise.

8. The light-emission controlling apparatus according to claim 1, wherein when said light-emission mode selecting means selects the first light-emission mode, said control means enables said light-emitting means to simply light up, and when said light-emission mode selecting means selects the second light-emission mode, said control means enables said light-emitting means to flash on and off during a predetermined period of time.

9. The light-emission controlling apparatus according to claim 1, wherein when said light-emission mode selecting means selects the first light-emission mode, said control means enables said light-emitting means to simply light up, and when said light-emission mode selecting means selects the second light-emission mode, said control means enables said light-emitting means to flash on and off only a predetermined number of times.

10. The light-emission controlling apparatus according to claim 1, wherein said detecting means detects the light-emission state of said light-emitting means by acquiring plural pieces of information each showing how long or how many times said light-emitting means has been used, and wherein said control means selects one from among the plurality of light-emission modes according to the plural pieces of information acquired by said detecting means, and for enabling said light-emitting means to emit light in one said light-emission mode selected.

11. The light-emission controlling apparatus according to claim 1, further comprising another light-emitting means for emitting light, wherein when said light-emission mode selecting means selects the second light-emission mode, said control means causes said other light-emitting means to emit light.

12. A light-emission controlling apparatus comprising:

a light-emitting means for emitting light;

a means for determining whether or not a time to replace said light-emitting means has come so as to select a first light-emission mode when determining that a time to replace said light-emitting means has not come and select a second light-emission mode when determining that a time to replace said light-emitting means has come, and for enabling said light-emitting means to emit light in the selected first or second light-emission mode; and a communications means through which information about the light-emission state of said light-emitting means detected by said detecting means is transmitted.

13. The light-emission controlling apparatus according to claim 12, wherein said determining means includes a means for measuring the integral of the length of time that said light-emitting means has emitted light since it was attached to said light-emission controlling apparatus, a comparing means for comparing the measured integral of the length of time that said light-emitting means has emitted light to a reference value, a light-emission mode selecting means for selecting either the first light-emission mode or the second light-emission mode according to a comparison result from said comparing means, and a means for transmitting the information about the comparison result from said comparing means, as the information about the light-emission state of said light-emitting means, to a display device disposed outside said light-emission controlling apparatus by way of said communications means, and for displaying the information about the comparison result on the display device.

14. The light-emission controlling apparatus according to claim 12, wherein said determining means includes a means for measuring or counting the number of times that said light-emitting means has emitted light since it was attached to said light-emission controlling apparatus, a comparing means for comparing the measured number of times that said light-emitting means has emitted light to a reference value, a light-emission mode selecting means for selecting either the first light-emission mode or the second light-emission mode according to a comparison result from said comparing means, and a means for transmitting the information about the comparison result from said comparing means, as the information about the light-emission state of said light-emitting means, to a display device disposed outside said light-emission controlling apparatus by way of said communications means, and for displaying the information about the comparison result on the display device.

15. The light-emission controlling apparatus according to claim 12, wherein said determining means includes a means for measuring intensity of light emitted out of said light-emitting means, temperature of said light-emitting means or ambient temperature in the vicinity of said light-emitting means, power supplied to said light-emitting means, or a voltage applied to said light-emitting means, a comparing means for comparing the light intensity, ambient temperature, voltage, current or power measured by said measuring means to a corresponding reference value, a light-emission mode selecting means for selecting either the first light-emission mode or the second light-emission mode according to a comparison result from said comparing means, and a means for transmitting the information about the comparison result from said comparing means, as the information about the light-emission state of said light-emitting means, to a display device disposed outside said light-emission controlling apparatus by way of said communications means, and for displaying the information about the comparison result on the display device.

16. The light-emission controlling apparatus according to claim 12, wherein when said light-emission mode selecting means selects the first light-emission mode, said control means enables said light-emitting means to simply light up, and when said light-emission mode selecting means selects the second light-emission mode, said control means enables said light-emitting means to flash on and off during a predetermined period of time.

17. The light-emission controlling apparatus according to claim 12, wherein when said light-emission mode selecting means selects the first light-emission mode, said control means enables said light-emitting means to simply light up, and when said light-emission mode selecting means selects the second light-emission mode, said control means enables said light-emitting means to flash on and off only a predetermined number of times.

* * * * *